US008409778B2

(12) United States Patent
Wada et al.

(10) Patent No.: US 8,409,778 B2
(45) Date of Patent: Apr. 2, 2013

(54) RESIN COATED CARRIER, TWO-COMPONENT DEVELOPER, DEVELOPING DEVICE AND IMAGE FORMING APPARATUS

(75) Inventors: Osamu Wada, Osaka (JP); Tadashi Iwamatsu, Osaka (JP); Takanori Kamoto, Osaka (JP); Nobuyuki Yoshioka, Osaka (JP); Natsuki Matsuura, Shibukawa (JP); Nobuhiro Seki, Shibukawa (JP); Masatomo Hayashi, Shibukawa (JP)

(73) Assignees: Sharp Kabushiki Kaisha, Osaka (JP); Kanto Denka Kogyo Co., Ltd., Tokyo (JP)

( * ) Notice: Subject to any disclaimer, the term of this patent is extended or adjusted under 35 U.S.C. 154(b) by 497 days.

(21) Appl. No.: 12/691,430

(22) Filed: Jan. 21, 2010

(65) Prior Publication Data

US 2010/0183340 A1 Jul. 22, 2010

(30) Foreign Application Priority Data

Jan. 21, 2009 (JP) ..... P2009-011421

(51) Int. Cl.
*G03G 15/08* (2006.01)

(52) U.S. Cl. ..... 430/111.1; 430/111.32; 430/111.33; 430/111.34

(58) Field of Classification Search ..... 430/106.1, 430/106.2, 111.1–111.41
See application file for complete search history.

(56) References Cited

U.S. PATENT DOCUMENTS

| | | | | |
|---|---|---|---|---|
| 6,514,654 | B1 * | 2/2003 | Kanbayashi et al. | 430/122.2 |
| 2005/0233239 | A1 | 10/2005 | Fujiwara et al. | |
| 2005/0287484 | A1 * | 12/2005 | Yano et al. | 430/434 |
| 2006/0251982 | A1 | 11/2006 | Iwatsuki et al. | |
| 2007/0015078 | A1 | 1/2007 | Suzuki et al. | |
| 2008/0014514 | A1 | 1/2008 | Kamoto | |
| 2008/0138732 | A1 * | 6/2008 | Lai et al. | 430/109.3 |
| 2008/0280224 | A1 * | 11/2008 | Inoue et al. | 430/105 |
| 2008/0299471 | A1 | 12/2008 | Kamoto et al. | |

FOREIGN PATENT DOCUMENTS

| | | | |
|---|---|---|---|
| CN | 101105652 | A | 1/2008 |
| JP | 57096355 | A * | 6/1982 |
| JP | 7-72666 | | 3/1995 |
| JP | 2000-250254 | | 9/2000 |
| JP | 2002-14493 | | 1/2002 |
| JP | 2004-157473 | | 6/2004 |
| JP | 2005-215136 | | 8/2005 |
| JP | 2005-308923 | | 11/2005 |
| JP | 2006-154019 | | 6/2006 |
| JP | 2006-313323 | | 11/2006 |
| JP | 2007-33568 | | 2/2007 |
| JP | 2008-298891 | | 12/2008 |

* cited by examiner

*Primary Examiner* — Mark F Huff
*Assistant Examiner* — Rashid Alam
(74) *Attorney, Agent, or Firm* — Nixon & Vanderhye P.C.

(57) ABSTRACT

A resin coated carrier is provided that can stably charge a toner having added thereto an external additive having a large particle size over a long period of time and can prevent blocking of a developer. The resin coated carrier satisfies the following formula (1):

$$\log(Mb/Ma)>2 \quad (1)$$

in which Ma is a weight average molecular weight of a silicone resin having the minimum weight average molecular weight, contained in a resin coating layer, and Mb is a weight average molecular weight of a silicone resin having the maximum weight average molecular weight, and the following formula (2) is satisfied:

$$0.5 \leqq -\log(A/B) \leqq 2.5 \quad (2)$$

in which A is a volume resistance (Ω/cm) under electric field of 1,000 V/cm obtained by conducting a stirring test, and B is a volume resistance (Ω/cm) under electric field of 1,000 V/cm before the stirring test.

6 Claims, 3 Drawing Sheets

RESIN COATED CARRIER, TWO-COMPONENT DEVELOPER, DEVELOPING DEVICE AND IMAGE FORMING APPARATUS

CROSS-REFERENCE TO RELATED APPLICATION

This application claims priority to Japanese Patent Application No. 2009-011421, which was filed on Jan. 21, 2009, the contents of which are incorporated herein by reference in its entirety.

BACKGROUND OF THE INVENTION

1. Field of the Invention

The present invention relates to a resin coated carrier used in an electrophotographic image forming apparatus for developing an electrostatic latent image formed on an image bearing member to visualize, a two-component developer including the resin coated carrier, a developing device using the two-component developer and an image forming apparatus.

2. Description of the Related Art

Image forming apparatuses employing an electrophotographic technology such as printers and copiers use, as a developer for developing an electrostatic latent image formed on an image bearing member to form a visible image, a two-component developer consisting of a toner and a carrier or a one-component developer consisting of a toner alone, for example. A magnetic brush development method that uses the two-component developer among them is excellent in image quality and high-speed printing compared to other development methods, and is therefore widely used.

An image forming apparatus using the magnetic brush development method is provided with a developer bearing member comprising, for example, a cylindrical-shaped metal sleeve and a magnet roller provided inside the metal sleeve, in which permanent magnets are provided as a magnetic field generating section with a N pole and a S pole arranged alternately. By causing the surface of the metal sleeve of the developer bearing member to carry the two-component developer and rotating only the metal sleeve with the magnet roller fixed, it is possible to transport the two-component developer to a development area that faces an image bearing member on which an electrostatic latent image has been formed. A development electric field applied between the developer bearing member and the image bearing member causes only a charged toner to electrostatically attach to the image bearing member to form a visible image.

The toner in the two-component developer is mixed and stirred with the carrier in a developing unit including the developer bearing member so as to be charged through contact friction. In dry two-component development, an electrostatic force of the frictionally charged toner is used for electrically handling to form a visible image on the image bearing member, and it is therefore important to control a charge amount of the toner. Although the charge amount of the toner varies depending on various conditions in a system, it is desirable that a value of the charge amount of the toner is stabilized for stability of the system.

Furthermore, high-quality and high-speed printing tends to be considered as important in copiers and printers in recent years. In this case, charge stability of the developer becomes particularly important. To achieve formation of a high-quality image, it is necessary to arrange a determined amount of the toner to a determined place. In the electrophotographic method, handling of the toner is performed by an electrostatic force, and the toner is required to maintain high charge at a certain level or more so that the toner overpowers other external forces such as an adhesive force to be transported by an electric field. In addition, since the number of print sheets is increased with increase in speed of an image forming apparatus, it is strongly demanded to reduce the number of times or the labor of the maintenance and a developer that operates stably over a long term is desired.

For such a demand, the carrier needs to frictionally charge the toner to a desirable polarity and to a desirable charge amount over a long term constantly. The carrier generally used in the two-component developer for charging the toner is different from the toner and stays in the developing unit for a long term, it is concerned that the charge applying capability is reduced due to toner spent or stress from stirring and mixing. In addition, there is also a concern that toner scattering resulting therefrom causes contamination in an image forming apparatus. Accordingly, a highly-durable carrier that withstands degradation over time and that is capable of stably maintaining the charge amount of the toner over a long term is required.

In order to meet such a demand for the carrier, a resin coated carrier having the carrier surface coated with a resin has been proposed. Specific examples thereof include a resin coated carrier having the carrier surface coated with a styrene-acrylic copolymer resin or a polyurethane resin each having high surface energy, and a resin coated carrier having the carrier surface coated with a fluorine resin having low surface energy. The styrene-acrylic copolymer resin and the polyurethane resin having high surface energy have great adhesiveness to a carrier core, but have a drawback that the toner is easily spent, whereas the fluorine resin having low surface energy has poor adhesiveness to a carrier core although being effective against the toner-spent, and therefore, there is a drawback that the resin coating layer separates from the carrier core in stirring in the developing tank and stable charging is inhibited.

For the purpose of improvement of those drawbacks, a resin coated carrier using two or more of resins having different molecular weight in coating a carrier with a resin is proposed to increase durability of a resin coating layer and adhesion to a carrier core. For example, Japanese Unexamined Patent Publication JP-A 7-72666 (1995) discloses an electrophotographic carrier comprising a carrier core coated with a resin, wherein the coating resin has a weight average molecular weight of 50,000 to 250,000 and has a molecular weight distribution measured by Gel Permeation Chromatography (abbreviated as GPC) such that the maximum value of a low molecular weight component appears in a weight molecular weight region of 10,000 to 60,000 and the maximum value of a high molecular weight component appears in a weight molecular weight region of 100,000 to 300,000.

Japanese Unexamined Patent Publication JP-A 2002-14493 discloses an electrophotographic carrier comprising a core comprising at least a magnetic material, and at least a silicone resin coating layer formed on the surface of the core, wherein the silicone resin is prepared by crosslinking a silicone compound having two or more molecular weight peaks on the basis of weight.

Japanese Unexamined Patent Publication JP-A 2007-33568 discloses an electrophotographic developing carrier comprising magnetic particles containing soft ferrite, a low molecular silicone resin layer having a weight average molecular weight of 300 to 1,000 formed on the surface of the magnetic particles, and a high molecular silicone resin layer having a weight average molecular weight of 5,000 or more formed on the surface of the low molecular silicone resin layer.

In recent years, a full color image forming apparatus is advanced, and with the advancement, improvement in a toner is actively conducted. Improvement in a wax resin and an external additive of a toner is part of the improvement. A toner used in oilless fixing contains a low-boiling wax resin dispersed therein in order to ensure fixing releasability in the toner itself. When thermal stress is applied to a two-component developer containing such a toner, a wax oozes on the surface of a toner, resulting in contamination of the surface of a carrier. As a result, charge performance of a developer to a toner is decreased, and additionally, blocking of a developer is induced. When decrease in charge performance to a toner and blocking occur, image quality is deteriorated, and life of a developer is extremely shortened.

An external additive of a toner imparts fluidity to a toner and further has a function as a control aid of a charging amount of a toner. In a full color image forming apparatus, an external additive having a large particle size, specifically an external additive having an average primary particle size of 50 nm or more, tends to be added for the purpose of increasing transfer efficiency of a toner. However, when a developer comprising a toner having an external additive having a large particle size added thereto, and a carrier is used over a long period of time, the external additive having a large particle size easily adheres to the surface of the carrier and accumulates thereon. As a result, normal frictional charging between a toner and a carrier is prevented by adhesion of an external additive, and charge imparting ability of a carrier is decreased. For this reason, in the case of using a toner comprising a two-component developer and an external additive having a large particle size added thereto, it is difficult to stably charge a toner over a long period of time.

Against those problems, the electrophotographic carrier disclosed in JP-A 7-72666 uses an acrylic resin having relatively high surface energy as a resin coating layer. As a result, blocking of a developer is generated by the use of such a carrier over a long period of time, and the feeding amount of a developer is decreased.

Further, the electrophotographic carriers disclosed in JP-A 2002-14493 and JP-A 2007-33568 are that the surface of a resin coating layer is difficult to be scraped off. For this reason, in the case of using the electrophotographic carriers disclosed in JP-A 2002-14493 and JP-A 2007-33568 together with a toner having added thereto an external additive having a large particle size, the external additive having a large particle size accumulates on the surface of a resin coating layer due to the use over a long period of time. As a result, charge imparting ability of a carrier is decreased, and charge stability of a toner is decreased.

SUMMARY OF THE INVENTION

An object of the invention is to provide a resin coated carrier that can stably charge a toner having added thereto an external additive having a large particle size over a long period of time and can prevent blocking of a developer, a two-component developer, a developing device, and an image forming apparatus.

The invention provides a resin coated carrier which is used together with a toner comprising toner particles and an external additive having an average primary particle size of 50 nm or more externally added thereto, comprising:

a carrier core; and a resin coating layer comprising a resin comprising at least two of silicone resins having different weight average molecular weight, formed on a surface of the carrier core, the resin coating layer satisfying the following formula (1):

$$\log(Mb/Ma)>2 \quad (1)$$

in which Ma is a weight average molecular weight of a silicone resin having the minimum weight average molecular weight out of the at least two of silicone resins, and Mb is a weight average molecular weight of a silicone resin having the maximum weight average molecular weight out of the at least two of silicone resins contained in the resin coating layer, and the following formula (2) being satisfied:

$$0.5 \leqq -\log(A/B) \leqq 2.5 \quad (2)$$

in which A is a volume resistance (Ω/cm) under electric field of 1,000 V/cm obtained by conducting a stirring test, and B is a volume resistance (Ω/cm) under electric field of 1,000 V/cm before the stirring test.

According to the invention, the resin coating layer is formed using the silicone resin satisfying the above formula (1). Therefore, the resin coated carrier has a uniform resin coating layer formed thereon. As a result, the resin coated carrier of the invention on which a uniform resin coating layer is formed using a silicone resin satisfying the above formula (1) has smaller exposed area of a carrier core having high surface energy, and blocking of a developer comprising a toner and a carrier can be prevented in the use thereof over a long period of time. Furthermore, in the case of using the resin coated carrier together with a toner having an external additive externally added thereto, the external additive can be suppressed from being adhered on the surface of the resin coated carrier.

The resin coated carrier of the invention is satisfied with the above formula (2). −log(A/B) represents change in volume resistance. The fact that there is a change in volume resistance before and after a stirring test means that surface state of a resin coated carrier has changed before and after the stirring test, that is, scraping of the resin coating layer of the resin coated carrier proceeds by the stirring in a developing tank. When −log(A/B) is less than 0.5, the scraping of the resin coating layer does not proceed sufficiently, and when −log(A/B) exceeds 2.5, the scraping undesirably proceeds. When the resin coated carrier of the invention has −log(A/B) satisfying the above formula (2), even though a large-particle-sized external additive having an average primary particle size of 50 nm or more is adhered to the surface of the resin coated carrier, the resin coating layer is appropriately scraped by the stirring in a developing tank, and the surface of the resin coating layer is renewed by a resin coating layer on which an external additive is not adhered. Furthermore, when −log(A/B) falls within the range satisfying the above formula (2), even though the resin coating layer of the resin coated carrier is scraped, charge imparting ability of the resin coated carrier to a toner is maintained. As a result, the resin coated carrier can suppress decrease in charge imparting ability to a toner, caused by the adhesion of an external additive to the surface of the resin coated carrier.

Therefore, a developer comprising the resin coated carrier and a toner having an average primary particle size of 50 nm or more externally added thereto can suppress adhesion of the external additive to the surface of the resin coated carrier, and permits the external additive having an average primary particle size of 50 nm or more to contribute to the improvement of transfer efficiency. Further, even though the large-particle-sized external additive having an average primary particle size of 50 nm or more adheres to the surface of the resin coated carrier, the scraping of the resin coating layer of the resin coated carrier is appropriately proceeded while maintaining the charge imparting ability of the resin coated carrier to a toner. As a result, blocking of a developer can be prevented over a long period of time even though the number of sheets printed is increased. Furthermore, fluidity of a developer can be maintained good, and a toner can stably be charged.

Furthermore, in the invention, it is preferable that conductive particles are contained in the resin coating layer.

According to the invention, the resin coated carrier contains conductive particles in the resin coating layer. Therefore, charge imparting property of the resin coated carrier to a toner is further improved.

Further, in the invention, it is preferable that the volume average particle size of the resin coated carrier is 35 to 55 μm.

According to the invention, the resin coated carrier has a volume average particle size of 35 to 55 μm. Therefore, feeding of a toner is stable. Furthermore, because the resin coated carrier has a volume average particle size of 35 to 55 μm, increase in adhesion of a carrier due to too small volume average particle size can be suppressed, and deterioration of graininess of an image due to too large volume average particle size can be suppressed. Therefore, use of the resin coated carrier enables formation of a high definition image. Adhesion of a carrier means a phenomenon that a carrier adheres to an image carrier when a toner is developed from a developer carrier to the image carrier.

The invention provides a two-component developer comprising the resin coated carrier mentioned above and a toner to which an external additive having an average primary particle size of 50 nm or more is externally added.

According to the invention, the two-component developer comprises the resin coated carrier, and a toner to which an external additive having an average primary particle size of 50 nm or more is externally added. Therefore, the toner to which an external additive having an average primary particle size of 50 nm or more is externally added can stably charge over a long period of time, and a high-quality image having small image defect such as fogging can be formed.

Further, the invention provides a developing device which carries out development using the two-component developer mentioned above.

According to the invention, the developing device carries out development using the two-component developer mentioned above. Therefore, development can be carried out while stabilizing the charging amount of a toner.

Further, the invention provides an image forming apparatus comprising the developing device mentioned above.

According to the invention, the image forming apparatus is provided with the developing device. Therefore, a high-quality image having small fogging can be formed over a long period of time.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
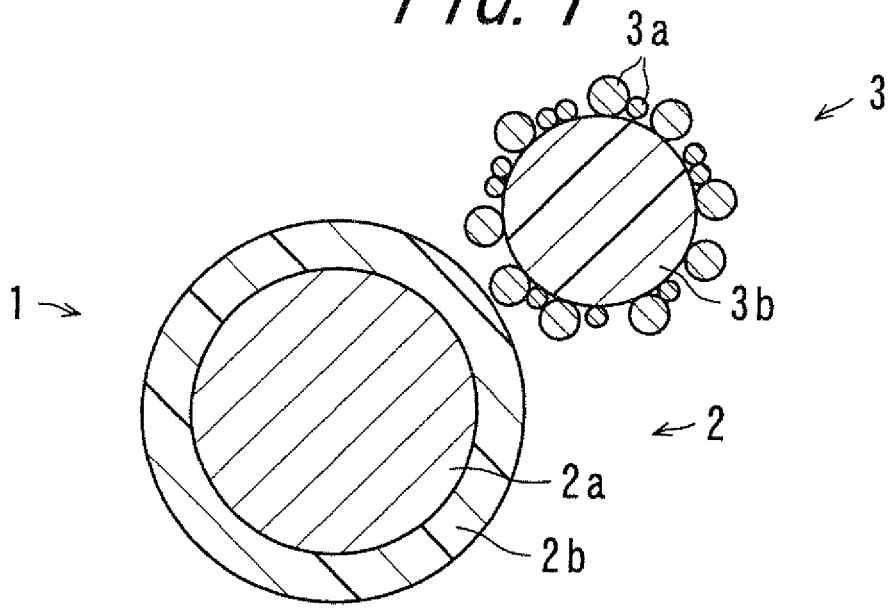
FIG. 1 is a cross-sectional view schematically showing a structure of a two-component developer including a resin coated carrier.

Now referring to the drawings, preferred embodiments of the invention are described below.

1. Resin Coated Carrier

First, the resin coated carrier according to the embodiment of the invention is described. The resin coated carrier is used as a two-component developer together with a toner. FIG. 1 is a sectional view schematically showing the constitution of a two-component developer 1 containing a resin coated carrier 2 according to the embodiment. The two-component developer 1 contains the resin coated carrier 2, and a toner 3 comprising a toner particle 3*b* to which an external additive 3*a* having an average primary particle size of 50 nm or more is externally added. The resin coated carrier 2 contains a carrier core 2*a* and a resin coating layer 2*b*. The toner 3 contains the toner particle 3*b* and the external additive 3*a*. Unless otherwise indicated as "particle", a carrier means the entire carrier, and a toner means the entire toner.

(1) Carrier Core

As the carrier core, the one commonly used in the art is usable, including, for example, a magnetic metal such as iron, copper, nickel and cobalt, and a magnetic metal oxide such as a ferrite and a magnetite. When the carrier is formed from a magnetic substance described above, it is possible to obtain a carrier suitable for a developer used in a magnetic brush development method. Among them, a ferrite is preferably used since the ferrite is capable of realizing a resin coated carrier which is excellent in charging performance and durability and has proper saturation magnetization.

The volume resistance value of the carrier core in an electric field of 1000 V/cm preferably falls in a range of $1.0\times10^7$ Ω/cm or more and $1.0\times10^9$ Ω/cm or less. When the volume resistance of the carrier core in an electric field of 1000 V/cm is in such a range, it is possible to obtain a development electrode effect and to form a high-density image. The development electrode effect refers to an effect that the carrier serves as an electrode between a developer bearing member and a photoreceptor so that a Coulomb force received from an electric field is easily transmitted to the toner. When the toner receives the Coulomb force, the carrier with a lower volume resistance value produces greater development electrode effect.

Figure 2:
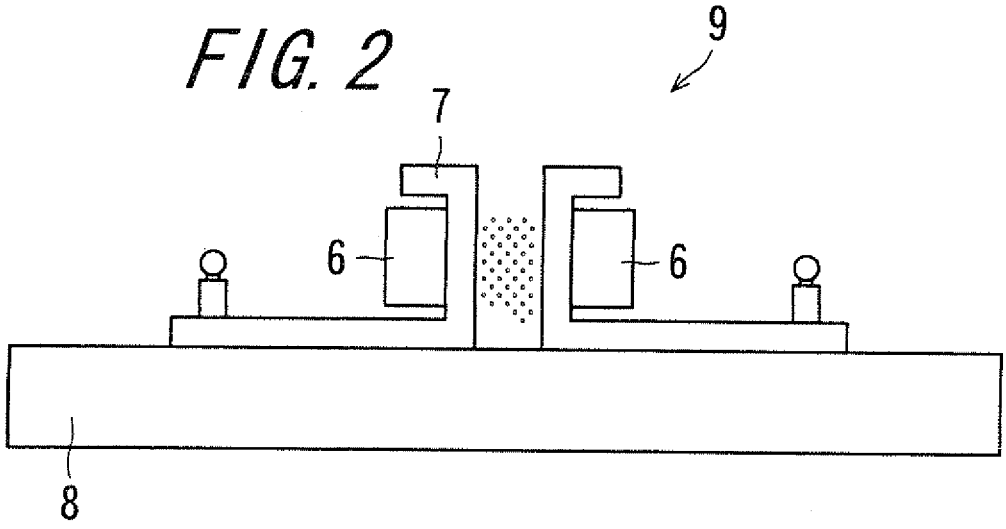
FIG. 2 is a schematic view schematically showing a structure a measurement jig.

Herein, the volume resistance value of the carrier core in an electric field of 1000 V/cm is measured with a measurement jig 9 as shown in FIG. 2. FIG. 2 is a schematic view schematically showing a structure of the measurement jig 9. The measurement jig 9 is constituted by a magnet 6, electrodes 7 made of aluminum, and a board (an acrylic resin board) 8. The electrodes 7 have an interval of 1 mm therebetween and form paralleled-plate electrodes having a size of 10 mm×40 mm. Between the electrodes, 200 mg of the carrier core is inserted, and subsequently the magnets 6 (with a surface magnetic flux density of 1500 gauss, and a magnet area of 10 mm×30 mm in a facing part) are disposed with the N pole faced to the S pole to hold the carrier core between the electrodes. A DC voltage that is stepped by 1 V up to 800 V is applied to the electrodes 7 to measure a current value thereof and calculate a bridge resistance value, and the value of which is defined as the volume resistance value of the carrier core. The volume resistance value of the resin coated carrier in an electric field of 1000 V/cm, which will be described below, is also a value calculated in the same manner by using the same measurement jig 9.

The volume average particle size of the carrier core is preferably 35 to 55 μm. When the volume average particle size of the carrier core is in such a range, it is possible to stabilize the toner transportation and form a high-definition image. When the volume average particle size of the carrier core is less than 35 μm, the resin coated carrier easily has a small volume average particle size and the resin coated carrier having a small volume average particle size causes an increase in carrier attachment, which is therefore not preferable. When the volume average particle size of the carrier core exceeds 55 μm, the resin coated carrier easily has a large volume average particle size and the resin coated carrier having a large volume average particle size is poor in granularity to deteriorate image quality, which is therefore not preferable.

The volume average particle size of the carrier core is a value measured with a laser diffraction/scattering type grain size measuring device (for example, MICROTRAC MT 3000 manufactured by NIKKISO Co., Ltd.)

(2) Resin Coating Layer

The resin coating layer can be formed by coating the surface of the carrier core with a resin coating layer composition. The resin coating layer composition can be produced by mixing a given amount of a crosslinkable silicone resin, and if needed, an appropriate amount of one or more selected from additives such as conductive particles, an amino-containing silane coupling agent, a resin other than a silicone resin, and a bifunctional silicone oil.

(Resin)

The resin contained in the resin coating layer uses a silicone resin. Use of the silicone resin can improve releasability of a toner from a carrier at the time of development, and this makes developability good. Furthermore, the use can make the resin coating layer have a desired hardness, and can make adhesion to the carrier core good. As a result, the effect of stably charging a toner over a long period of time can remarkably be exhibited.

The amount of the silicone resin preferably falls within a range of 0.4 part by weight or more and 2.0 parts by weight or less based on 100 parts by weight of the carrier core. When the amount of the resin in the resin coating layer falls within this range, a carrier achieving change in volume resistance described hereinafter can further easily be obtained. Where the amount of the resin is less than 0.4 part by weight, exposed area of the carrier core is increased, and as a result, the carrier core is susceptible to the change by environment, particularly influence of humidity, which is not preferred. On the other hand, where the amount of the resin is larger than 2.0 parts by weight, the resin cannot uniformly be applied to the surface of the carrier core. As a result, carriers agglomerate with each other, resulting in deterioration of yield of a carrier, which is not preferred.

Further, the silicone resin uses two or more of silicone resins having different weigh average molecular weight. When Ma is a weight average molecular weight of a silicone resin having the minimum weight average molecular weight out of the two or more of silicone resins, and Mb is a weight average molecular weight of a silicone resin having the maximum weight average molecular weight out of two or more of silicone resins contained in the resin coating layer, Ma and Mb are selected so as to be satisfied with the following formula (1):

$$\log(Mb/Ma)>2 \quad (1)$$

When the respective weigh average molecular weights of the two or more of silicone resins are satisfied with the above formula (1), the resin coating layer can be made to have a desired hardness, and can uniformly be applied to the surface of the core. Furthermore, adhesion between the resin coating layer and the carrier core can further be improved. As a result, the effect of stably charging a toner over a long period of time can further remarkably be exhibited. The range of Ma preferably falls within a range of $3.0\times10^2$ or more and $5.0\times10^3$ or less. The range of Mb preferably falls within a range of $5.0\times10^4$ or more and $5.0\times10^5$ or less. The amount of the silicone resin having a weight average molecular weight of Ma preferably falls within a range of 0.2 part by weight or more and 1.0 part by weight or less based on 100 parts by weight of the carrier core. The amount of the silicone resin having a weight average molecular weight of Mb preferably falls within a range of 0.2 part by weight or more and 1.0 part by weight based on 100 parts by weight of the carrier core. The ratio of the amount of the silicone resin having a weight average molecular weight of Ma to the amount of the silicone resin having a weight average molecular weight of Mb is preferably 1:4 to 4:1. In the case of using three or more of silicone resins, a weight average molecular weight of a silicone resin having a weight average molecular weight larger than Ma and smaller than Mb is not particularly limited. The amount of such a resin used is not particularly limited so long as the whole amount of resins is not too large.

The resin is more preferably a crosslinkable silicone resin. When the crosslinkable silicone resin is contained, releasability of a toner from a carrier at the time of development can further be improved, and as a result, developability can further be improved. For this reason, all resins contained in the resin coating layer are preferably a crosslinkable silicone resin.

The crosslinkable silicone resin is a known silicone resin in which hydroxyl groups bonded to a Si atom or a hydroxyl group and an —OX group bonded to a Si atom are crosslinked with each other and cured by a thermal dehydration reaction, a room temperature curing reaction and the like, as shown in the following chemical formula.

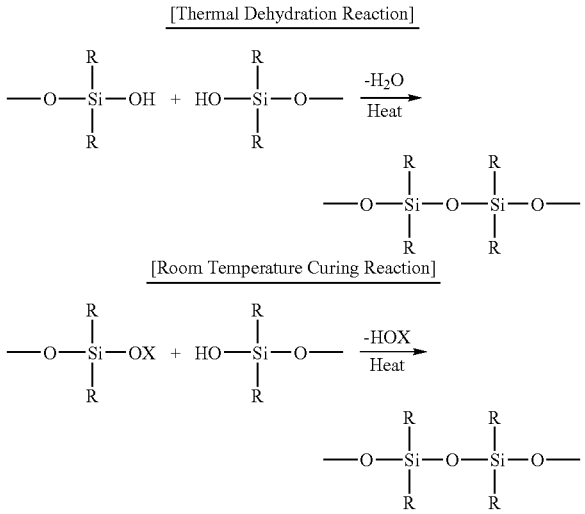

(wherein, a pluality of "R"s represent the same or different monovalent organic groups, and —OX represents an acetoxy group, an aminoxy group, an alkoxy group, and an oxime group, etc.)

It is not particularly restricted as the crosslinkable silicone resin, both of thermosetting silicone resin and cold setting silicone resin are usable. In order to cross-link the thermosetting silicone resin, it is necessary to heat the resin up to a temperature around 200° C. to 250° C. In order to cure the cold setting silicone resin, although it is not necessary to heat the resin, the resin is preferably heated up to a temperature around 150° C. to 280° C. for the purpose of shortening a length of time required for curing.

Among the crosslinkable silicone resin, preferable is the silicone resin of which monovalent organic group represented by R is a methyl group. Since the crosslinkable silicone resin containing a methyl group represented by R has a dense cross-linked structure, the use of the crosslinkable silicone resin in forming the resin coating layer on the carrier core will result in a carrier which is favorable in water-shedding property, moisture resistance, and the like property. However, when a cross-linked structure is too dense, the resin coating layer tends to exhibit the brittleness. It is therefore important to select a molecular weight of the crosslinkable silicone resin.

Further, a weight ratio (Si/C) between silicon and carbon in the crosslinkable silicone resin is preferably 0.3 to 2.2. When Si/C is less than 0.3, hardness of the resin coating layer is decreased and thus there is a concern that a length of life of the carrier is shortened. On the other hand, when Si/C exceeds 2.2, the charge imparting property of the carrier to the toner becomes more susceptible to a temperature change and thus there is a concern that the resin coating layer leads to the embrittlement.

It is possible to use a commercially-available crosslinkable silicone resin including, for example: SR2400, SR2410, SR2411, SR2510, SR2405, 840RESIN, and 804RESIN (all of which are trade names and manufactured by Dow Corning Toray Co., Ltd.); KR271, KR272, KR274, KR216, KR280, KR282, KR261, KR260, KR255, KR266, KR251, KR155, KR152, KR214, KR220, X-4040-171, KR201, KR5202, KR3093, KR240, KR350, KR400 (all of which are trade names and manufactured by Shin-Etsu Chemical Co., Ltd); and TSR127B (trade name and manufactured by Momentive Performance Materials Japan LLC. At least two crosslinkable silicone resins may be selected so as to meet the formula (1).

(Conductive Particles)

The resin composition preferably includes conductive particles. By including the conductive particles in the resin coating layer, it is possible to improve the charge imparting ability of the carrier to the toner, thus making it possible to charge the toner much more stably over a long term.

As the conductive particles, for example, a conductive carbon black, or an oxide such as a conductive titanic oxide or a tin oxide is used. To exhibit conductivity with a small amount of addition, a carbon black or the like is preferable, but there is a concern that carbon is separated from the resin coating layer of the carrier when used with a color toner. A conductive titanic oxide that is doped with antimony or the like may be used in such a case.

The conductive particles may be used each alone, or two or more of them may be used in combination. Although the volume average particle size of the conductive particles is not particularly limited, it is preferably 0.02 to 2 μm, and more preferably, 0.02 to 1 μm. Note that, the volume average particle size is a value measured with a laser diffraction/scattering type grain size measuring device (for example, LA-920 manufactured by HORIBA Ltd.).

Although the amount of conductive particles to be included in the resin coating layer is not particularly limited, it is preferably 30 parts by weight or less based on 100 parts by weight of the crosslinkable silicone resin, and more preferably, 1 part by weight or more and 30 parts by weight or less. When the amount of the conductive particles to be included exceeds 30 parts by weight based on 100 parts by weight of the crosslinkable silicone resin, the conductive particles easily fall off the resin coating layer, and it is concerned that a color image is affected. Further, there is a concern that mechanical strength of the resin coating layer and adhesiveness to the carrier core become insufficient and the resin coating layer is separated to expose the carrier core. When the resin coating layer is separated to expose the carrier core, there is a concern that charging performance is changed compared to that of the resin coated carrier in an initial stage and stable charging of the toner is inhibited.

When the amount of the conductive particles to be included is 30 parts by weight or less based on 100 parts by weight of the crosslinkable silicone resin, it is possible to prevent the conductive particles from falling off the resin coating layer and to suppress influence on a color image. Since it is also possible to improve the mechanical strength of the resin coating layer and the adhesiveness to the carrier core, a resin coating layer capable of stably charging the toner over a long period of time is realized. Accordingly, a developer capable of forming a high-quality image more stably is realized.

When the amount of the conductive particles to be included is less than 1 part by weight based on 100 parts by weight of the crosslinkable silicone resin, an effect of adding the conductive particles is not obtained to cause a concern that it is impossible to apply sufficient charges to the toner. When the amount of the conductive particles to be included is 1 part by weight or more based on 100 parts by weight of the crosslinkable silicone resin, an effect of adding the conductive particles is exerted more reliably so that sufficient charges can be applied to the toner.

(Silane Coupling Agent)

The resin coating layer may contain a silane coupling agent for more easier adjustment of a charge amount of the toner. Among the silane coupling agents, preferably used is a silane coupling agent which has an electron-releasing functional group, and more preferably used is an amino group-containing silane coupling agent. As the amino group-containing silane coupling agent, it is possible to use a heretofore known silane coupling agent, for example, indicated by the following general formula (3):

$$(Y)nSi(R)m(Z)q \quad (3)$$

wherein "m" pieces of "R"s and "q" pieces of "Z"s are the same or different and represent an alkyl group, an alkoxy group, or a chlorine atom; and "n" pieces of "Y"s are the same or different and represent a hydrocarbon group containing an amino group, where "m" and "n" each represent an integer of 1 to 3 so as to satisfy the relation: m+q+n=4.

In the above general formula (3), examples of the alkyl group represented by R and Z include linear or branched alkyl groups having a carbon number of 1 to 4, such as a methyl group, an ethyl group, a propyl group, an isopropyl group, a butyl group, an isobutyl group, and a tert-butyl group, among which the methyl group and the ethyl group are preferred. Examples of the alkoxy group include linear or branched alkoxy groups having a carbon number of 1 to 4, such as a methoxy group, an ethoxy group, a propoxy group, an isopropoxy group, a butoxy group, an isobutoxy group, and a tert-butoxy group, among which the methoxy group and the ethoxy group are preferred. Examples of the hydrocarbon group containing an amino group represented by Y include —$(CH_2)$a-X (wherein "X" represents an amino group, an aminocarbonylamino group, an aminoalkylamino group, a phenylamino group, or dialkylamino group, and "a" represents an integer of 1 to 4), and -Ph-X (wherein "X" is as described above, and "-Ph-" represents a phenylene group).

Specific examples of the amino group-containing silane coupling agent include the following substances:

$H_2N(H_2C)_3Si(OCH_3)_3$;

$H_2N(H_2C)_3Si(OC_2H_5)_3$;

$H_2N(H_2C)_3Si(CH_3)(OCH_3)_2$;

$H_2N(H_2C)_2HN(H_2C)_3Si(CH_3)(OCH_3)_2$:

$H_2NOCHN(H_2C)_3Si(OC_2H_5)_3$;

$H_2N(H_2C)_2HN(H_2C)_3Si(OCH_3)_3$;

$H_2N$-Ph-$Si(OCH_3)_3$ (wherein -Ph- represents a p-phenylene group);

Ph-$HN(H_2C)_3Si(OCH_3)_3$ (wherein Ph- represents a phenyl group); and $(H_9C_4)_2N(H_2C)_3Si(OCH_3)_3$.

The amino group-containing silane coupling agents may be used each alone, and two or more of the amino group-containing silane coupling agents may be used in combination. A usage of the amino group-containing silane coupling agent may be appropriately selected from such a range that sufficient charges are applied to the toner and that the mechanical strength, and the like of the resin coating layer does not deteriorate. The usage of the amino group-containing silane coupling agent is preferably 10 parts by weight or less, and more preferably 0.01 part by weight or more and 10 parts by weight or less, based on 100 parts by weight of silicone resin.

(Other Additives)

The silicone resin composition may contain other types of resin, together with the silicone resin, in such a range that favorable properties of the resin coating layer formed of the silicone resin (especially, the crosslinkable silicone resin) are not impaired. Examples of the other types of resin include epoxy resin, urethane resin, phenol resin, acrylic resin, styrene resin, polyamide, polyester, acetal resin, polycarbonate, vinyl chloride resin, vinyl acetate resin, cellulose resin, polyolefin, and copolymer resin and compounded resin of the resins just cited. Further, the silicone resin composition for coating may contain bifunctional silicone oil, in order to further enhance the moisture resistance, releasing property, and the like property of the resin coating layer formed of the crosslinkable silicone resin.

(Method for Forming Resin Coating Layer)

One example of form of the resin coating layer composition is a form of solution in which the components stated above are dissolved in an organic solvent. As the organic solvent, any organic solvent can be used without particular limitation as long as the silicone resin can be dissolved in the organic solvent. Examples of the organic solvent include: aromatic hydrocarbons such as toluene and xylene; ketones such as acetone and methyl ethyl ketone; ethers such as tetrahydrofuran and dioxane; higher alcohols; and a mixed solvent of two or more of the substances just cited. The use of the silicone resin compound for coating in the solvent form (hereinafter referred to as "coat-resin liquid") allows the resin coating layer to be easily formed on the surface of core of the carrier.

For example, the carrier is manufactured in a manner that the coat-resin liquid is applied to the surface of core of the carrier to thereby form a coating layer and the coating layer is then heated to remove the organic solvent through volatilization and further cured under heat or merely cured during or after drying, thus resulting in the resin coated carrier of the invention.

As a method of applying the coat-resin liquid to the surface of core of the carrier, it is possible to employ, for example, a dipping method for impregnating the core of the carrier with the coat-resin liquid; a spraying method for spraying the core of the carrier with the coat-resin liquid; a fluid bed process for spraying the coat-resin liquid to the core of the carrier which is suspended in fluidizing air; and the like method. Among the methods just cited, preferred is the dipping method in which a resin coating layer can be easily formed.

For drying the coating layer, a drying accelerator can be used. As the drying accelerator, it is possible to use heretofore known ingredients including metal soap formed of, for example, salts of lead, iron, cobalt, manganese, and zinc of naphthyl acid, octylic acid, and the like; and organic amines such as ethanolamine.

The coating layer is cured at a heating temperature selected according to the type of the silicone resin. For example, a preferable heating temperature is around 150° C. to 280° C. As a matter of course, no heating is required in the case where the crosslinkable silicone resin in use is the cold setting silicone resin. In this case, however, there may be heating up to around 150° C. to 280° C. for the purpose of enhancing the mechanical strength of the to-be-formed resin coating layer, shortening the length of time for curing, and the like effect.

The total solid concentration of the coat-resin liquid is not particularly limited, but it is preferably adjusted such that a thickness of the cured resin coating layer is in a range of 0.1 μm or more and 3 μm or less in consideration of coating operability against the carrier core and the like. When the thickness of the resin coating layer is 0.1 μm or more and 3 μm or less, it is possible to charge the toner more stably without causing carrier attachment over a long term. The thickness of the resin coating layer of the resin coated carrier is obtainable by pulverizing the resin coated carrier in a mortar and thereafter observing a cross section of the pulverized resin coated carrier with a scanning electron microscope.

(3) Resin Coated Carrier

The resin coated carrier obtained above is used together with a toner comprising toner particles to which an external additive having an average primary particle size of 50 nm or more is externally added. The toner to which an external additive having an average primary particle size of 50 nm or more is externally added has high transfer efficiency as compared with a toner to which an external additive having an average primary particle size of less than 50 nm is externally added, particularly in a color toner, and the resin coated carrier of the invention can preferably be used together with the toner to which an external additive having an average primary particle size of 50 nm or more is externally added.

Further, the resin coated carrier has a carrier core and a resin coating layer formed on the surface of the carrier core. The resin coating layer is formed with a resin containing two or more of silicone resins having different average molecular weight. When Ma is a weight average molecular weight of a silicone resin having the minimum weight average molecular weight out of the two or more of silicone resins contained in the resin coating layer, and Mb is a weight average molecular weight of a silicone resin having the maximum weight average molecular weight out of two or more of silicone resins contained in the resin coating layer, Ma and Mb are satisfied with the above formula (1). The resin coated carrier using silicone resins satisfying the formula (1) is a resin coated carrier having a uniform resin coating layer formed thereon. Therefore, the resin coated carrier has small exposed area of a core having high surface energy, and does not generate blocking over a long-term use.

Furthermore, when A is a volume resistance (Ω/cm) under electric field of 1,000 V/cm obtained by conducting a stirring test, and B is a volume resistance (Ω/cm) under electric field of 1,000 V/cm before the stirring test, A and B satisfy the following formula (2).

$$0.5 \leqq -\log(A/B) \leqq 2.5 \quad (2)$$

The fact that −log(A/B) showing change in volume resistance of a resin coated carrier before and after a stirring test is a small value of less than 0.5 means that the resin coating layer of the resin coated carrier is difficult to be scraped. Therefore, when the resin coated carrier which is hard to be scraped is used over a long period of time, scraping of the resin coating layer of the resin coated carrier does not proceed sufficiently. As a result, an external additive having an average primary particle size of 50 nm or more accumulates on the surface the resin coated carrier, resulting in decreasing charge imparting ability of a carrier to a toner. The fact that −log(A/B) showing change in volume resistance is a large value exceeding 2.5 means that the resin coating layer of the resin coated carrier is easily scraped. Therefore, where the resin coated carrier which is easily scraped is used over a long period of time, scraping of the resin coating layer of the resin coated carrier undesirably proceeds excessively. As a result, a part of a carrier core is exposed, and carrier resistance is decreased, resulting in increasing adhesion of a carrier to an image carrier. When −log(A/B) falls within a range satisfying the above formula (2), scraping of the resin coating layer of the resin coated carrier can appropriately proceed by stirring in a developing tank, while maintaining charge imparting ability of the resin coated carrier to a toner.

Even though a large-particle-sized external additive having an average primary particle size of 50 nm or more adheres to the surface of the resin coated carrier of the embodiment, the resin coating layer is appropriately scraped by stirring in a developing tank and the surface of the resin coated carrier is renewed to a resin coating layer free of an external additive, while maintaining charge imparting ability of the resin coated carrier to a toner. In other words, the resin coated carrier satisfying the formula (2) can suppress decrease in charge imparting ability of a carrier by that the resin coating layer is appropriately scraped.

Accordingly, a developer containing the resin coated carrier of the embodiment and a toner to which an external additive having an average primary particle size of 50 nm or more is externally added has good transfer efficiency. Furthermore, even though the number of sheets to be printed is increased, generation of blocking of a developer is reduced over a long period of time, fluidity of a developer is good, and a toner is stably charged.

Herein, the stirring test is a test in which a developer that is obtained by mixing the resin coated carrier core and the toner so that a ratio of an entire projection area of the toner (total of the projection areas of all toner particles) to an entire surface area of the carrier core (total of the surface areas of all carrier cores) ((the entire projection area of toner/the entire surface area of carrier core)×100) (hereinafter referred to as "coverage θ") is 70% is placed in a glass bottle, and mixed and stirred by a mixer mill under conditions of 26.3 Hz for three hours. A method for measuring the volume resistance rate of the resin coated carrier subjected to the stirring test is the same as the method for measuring the volume resistance value of the carrier core described above.

The volume resistance of the resin coated carrier under electric field of 1,000 V/cm preferably falls within a range of $1.0\times10^{11}$ Ω/cm or more and $1.0\times10^{14}$ Ω/cm or less. When the volume resistance of the resin coated carrier under electric field of 1,000 V/cm preferably falls within the range, adhesion of a carrier is not generated, and a resin coated carrier having good charge rising characteristics to a toner can be obtained. Where the volume resistance of the resin coated carrier under electric field of 1,000 V/cm is less than $1.0\times10^{11}$ Ω/cm, adhesion of a carrier is increased. Where the volume resistance of the resin coated carrier under electric field of 1,000 V/cm exceeds $1.0\times10^{14}$ Ω/cm, image deterioration is induced.

The volume average particle size of the resin coated carrier preferably falls within a range of 35 μm or more and 55 μm or less. By using the resin coated carrier having the volume average particle size of 35 μm or more and 55 μm or less with the toner, toner transportation by the resin coated carrier in a developing process is stabilized and a high definition image can be formed. Although the resin coated carrier preferably has a spherical shape, the effect of the invention is not lost even in a non-spherical shape.

2. Two-Component Developer

The two-component developer (hereinafter sometimes referred to as a "developer") according to the embodiment of the invention is produced by mixing a toner to which a large-particle-sized external additive having an average primary particle size of 50 nm or more is externally added, and the resin coated carrier of the invention. The toner to which a large-particle-sized external additive having an average primary particle size of 50 nm or more is externally added is described below.

(1) Toner

The toner is a toner in which an external additive having an average primary particle size of 50 nm or more added to a toner particle. Materials of the toner particle include a binder resin, a colorant, a release agent, a charge control agent and the like.

(Binder Resin)

The binder resin is not particularly restricted, and a known binder resin for black toner or color toner is usable. Examples thereof include a polyester resin, a styrene resin such as polystyrene and a styrene-acrylic acid ester copolymer resin, an acrylic resin such as a polymethylmethacrylate, a polyolefin resin such as a polyethylene, a polyurethane, and an epoxy resin. In addition, a resin obtained by polymerization reaction by mixture of a monomer mixture material and a release agent may be used. The binder resins may be used each alone, or two or more of them may be used in combination.

In a case of using the polyester resin as the binder resin, examples of the aromatic alcohol ingredient required for obtaining the polyester resin include bisphenol A, polyoxyethylene-(2.2)-2,2-bis(4-hydroxyphenyl) propane, polyoxyethylene-(2.0)-2,2-bis(4-hydroxyphenyl) propane, polyoxypropylene-(2.0)-2,2-bis(4-hydroxyphenyl) propane, polyoxypropylene-(2.2)-polyoxyethylene-(2.0)-2,2-bis(4-hydroxyphenyl) propane, polyoxypropylene-(6)-2,2-bis(4-hydroxyphenyl) propane, polyoxypropylene-(2.2)-2,2-bis(4-hydroxyphenyl) propane, polyoxypropylene-(2.4)-2,2-bis(4-hydroxyphenyl) propane, polyoxypropylene-(3.3)-2,2-bis(4-hydroxyphenyl) propane, and derivatives thereof.

Further, examples of the polybasic acid ingredient in the polyester resin include dibasic acids such as succinic acid, adipic acid, sebasic acid, azelaic acid, dodecenyl succinic acid, n-dodecyl succinic acid, malonic acid, maleic acid, fumaric acid, citraconic acid, itaconic acid, glutaconic acid, cyclohexane dicarboxylic acid, ortho-phthalic acid, isophthalic acid, and terephthalic acid, tri- or higher basic acids such as trimellitic acid, trimethinic acid, and pyromellitic acid, as well as anhydrides and lower alkyl esters thereof. With a view point of heat resistant cohesion, terephthalic acid or lower alkyl esters thereof are preferred.

Here, an acid value of the polyester resin is preferably 5 to 30 mg KOH/g. When the acid value is less than 5 mg KOH/g, charging property of the resin is caused to decrease or the charge control agent is less likely to disperse in the polyester resin. This causes a concern that rising of the charge amount and stability of the charge amount at the time of repetitive developments in continuous use are negatively affected. When the acid value exceeds 30 mg KOH/g, there is a concern that hygroscopic property is enhanced by a functional group due to the acid value, causing a variation in the charge amount due to a change in usage environments, for example, a decrease in the charge amount in high-temperature and high-humidity environment. As a result, the above range is preferable. Note that, the acid value is measured in accordance with a potentiometric titration method described in Japanese Industrial Standards (SIS) K0070-1992.

A glass transition temperature (Tg) of the binder resin is not particularly limited and can be appropriately selected from a broad range, but in consideration of fixing property and storage stability of an obtained toner, 30° C. or more and 80° C. or less is preferable. When the glass transition temperature is less than 30° C., heat aggregation of toners easily occurs inside the image preparing apparatus due to insufficient storage stability, which may cause development failure. Further, a temperature at which high-temperature offset phenomenon begins to occur (hereinafter, referred to as "high-temperature offset-starting temperature") is lowered. The "high-temperature offset phenomenon" refers to a phenomenon in which, when a toner is heated and pressurized by a fixing member such as a heating roller so as to be fixed onto a recording medium, the overheating of the toner causes that an aggregation force of toner particles becomes lower than an adhesive force between the toner and the fixing member, so that a toner layer is segmented and the toner is partially removed by adherence to the fixing member. When the glass transition temperature exceeds 80° C., there is a concern that fixing failure occurs due to deterioration of fixing property.

A softening temperature ($T_{1/2}$) of the binder resin is not particularly limited and can be appropriately selected from a broad range, but it is preferably 150° C. or less, and more preferably 60° C. or more and 120° C. or less. When the softening temperature is less than 60° C., storage stability of the toner deteriorates and the heat aggregation of toners easily occurs inside the image preparing apparatus, which inhibits stable feeding of the toner to an image bearing member to cause a concern that development failure occurs. There is also a concern that a breakdown of the image preparing apparatus occurs. When the softening temperature exceeds 120° C., the toner is less easily fused or softened in fixing the toner onto a recording medium, thus causing a concern that fixing failure occurs due to deterioration of fixing property of the toner onto the recording medium.

A molecular weight of the binder resin is not particularly limited and can be appropriately selected from a broad range, but it is preferably 5,000 or more and 500,000 or less in a weight-average molecular weight (Mw). When the weight-average molecular weight is less than 5,000, mechanical strength of the binder resin is decreased and the obtained toner particles are easily pulverized by stirring or the like inside a developing device to change a shape of the toner particles, thus causing a concern that, for example, charging performance thereof have variations. When the weight-average molecular weight exceeds 500,000, the binder resin is less likely to be fused to deteriorate the fixing property of the toner, thus causing a concern that fixing failure occurs. Here, the weight-average molecular weight of the binder resin is a value in polystyrene equivalent, which is measured by a gel permeation chromatography (abbreviated as a GPC).

(Colorant)

As a colorant, various kinds of colorants are usable in accordance with a desired color; for example, a yellow toner colorant, a magenta toner colorant, a cyan toner colorant, a black toner colorant and the like.

As a yellow toner colorant, examples thereof include, in reference to the color index classification, an organic pigment such as C. I. Pigment Yellow 1, C. I. Pigment Yellow 5, C. I. Pigment Yellow 12, C. I. Pigment Yellow 15 and C. I. Pigment Yellow 17, C. I. Pigment Yellow 74, C. I. Pigment Yellow 93, C. I. Pigment Yellow 180 and C. I. Pigment Yellow 185; an inorganic pigment such as a yellow iron oxide and an ocher; a nitro dye such as C. I. Acid Yellow 1; and an oil soluble dye such as C. I. Solvent Yellow 2, C. I. Solvent Yellow 6, C. I. Solvent Yellow 14, C. I. Solvent Yellow 15, C. I. Solvent Yellow 19 and C. I. Solvent Yellow 21.

As a magenta toner colorant, examples thereof include, in reference to the color index classification, C. I. Pigment Red 49, C.I. Pigment Red 57, C. I. Pigment Red 81, C. I. Pigment Red 122, C. I. Solvent Red 19, C. I. Solvent Red 49, C. I. Solvent Red 52, C. I. Basic Red 10 and C. I. Disperse Red 15.

As a cyan toner colorant, examples thereof include, in reference to the color index classification, C.I. Pigment Blue 15, C. I. Pigment Blue 16, C. I. Solvent Blue 55, C. I. Solvent Blue 70, C. I. Direct Blue 25 and C. I. Direct Blue 86.

As a black toner colorant, examples thereof include carbon blacks such as channel black, roller black, disk black, gas furnace black, oil furnace black, thermal black, and acetylene black. The carbon black may be selected properly from among various kinds of carbon blacks mentioned above according to a target design characteristic of toner.

In addition to these pigments, bright red pigments, green pigments and the like are also usable as a colorant. The colorants may be used each alone, or two or more of them may be used in combination. Further, two or more of the similar color series are usable, or one of or two or more of the different color series are also usable.

The colorant may be used in the form of a masterbatch. The masterbatch of the colorant can be produced in the same manner as a general masterbatch. For example, a melted synthetic resin and a colorant are kneaded so that the colorant is uniformly dispersed in the synthetic resin, then the resultant mixture thus melt-kneaded is granulated to produce a masterbatch. For the synthetic resin, the same kind as the binder resin of the toner, or a synthetic resin having excellent compatibility with the binder resin of the toner is used. At this time, a ratio of the synthetic resin and the colorant to be used is not particularly restricted, but preferably 30 to 100 parts by weight based on 100 parts by weight of the synthetic resin. Further, the masterbatch is granulated so as to have a particle size of about 2 to 3 mm.

Further, the amount of a colorant to be used is not particularly restricted, but preferably 5 to 20 parts by weight based on 100 parts by weight of the binder resin. This amount does not refer to the amount of the masterbatch, but to the amount of the colorant itself included in the masterbatch. By using a colorant within such a range, it is possible to form a high-density and extremely high-quality image without damaging various physical properties of the toner.

(Release Agent)

The release agent is added to provide a toner with releasing property in fixing the toner onto a recording medium. Therefore, it is possible to increase the high-temperature offset-starting temperature and to improve the anti-high temperature offset property compared to the case where the release agent is not used. In addition, it is possible to fuse the release agent by the heat in fixing the toner, lower the fixing-starting temperature, and improve the anti-hot offset property. For the release agent, the one commonly used in the art is usable, including, for example, a petroleum wax such as a paraffin wax and a derivative thereof, and a microcrystalline wax and a derivative thereof; a hydrocarbon synthetic wax such as a Fischer-Tropsch wax and a derivative thereof, and a polyolefin wax and a derivative thereof, a low-molecular-weight polypropylene wax and a derivative thereof, and a polyolefin polymer wax (for example, a low-molecular-weight polyethylene wax) and a derivative thereof; a botanical wax such as a carnauba wax and a derivative thereof, a rice wax and a derivative thereof, a candelilla wax and a derivative thereof, and a Japan wax; an animal wax such as a beeswax and a spermaceti wax; a synthetic wax of fat and oil such as a fatty acid amide and a phenol fatty acid ester; a long-chain carboxylic acid and a derivative thereof; a long-chain alcohol and a derivative thereof; a silicone polymer; and a higher fatty acid. Note that, examples of the above derivatives include an oxide, a vinyl monomer-wax block copolymer, and a vinyl monomer-wax graft denatured material. Although the amount of the release agent to be used is not particularly limited and can be appropriately selected from a broad range, it is preferably 0.2 to 20 parts by weight based on 100 parts by weight of the binder resin.

(Charge Control Agent)

The charge control agent is added for the purpose of controlling a friction charging property of the toner. As the charge control agent, the one commonly used in the art for controlling a negative charge is usable. Examples of the charge control agent for controlling a negative charge include an oil-soluble dye such as an oil black and a spilon black; a metal-containing azo compound; an azo complex dye; a metal salt of naphthene acid; a metal complex or metal salt (where the metal is a chrome, a zinc, a zirconium or the like) of a salicylic acid and of a derivative thereof; a boron compound; a fatty acid soap; a long-chain alkylcarboxylic acid salt; and a resin acid soap. Among them, a boron compound, which does not contain heavy metal, is particularly preferable. The charge control agent may be selectively used depending on use. The charge control agents may be used each alone, or as necessary, two or more of them may be used in combination. The amount of the charge control agent to be used is not particularly limited and can be appropriately selected from a broad range, but it is preferably 0.5 to 3 parts by weight based on 100 parts by weight of the binder resin.

(Method for Manufacturing Toner)

A method for manufacturing toner particles is not particularly limited, and the toner particles are obtainable by any known manufacturing method. The toner particles can be manufactured by, for example, a melt-kneading pulverization method. The melt-kneading pulverization method includes, for example, a mixing step, a melt-kneading step, a pulverizing step, and a classifying step. According to the melt-kneading pulverization method, at the mixing step, a binder resin, a colorant, a release agent, a charge control agent and other additives are dry-mixed together in predetermined amounts to obtain a mixture. At the melt-kneading step, the obtained mixture is melt-kneaded, and the obtained melt-kneaded product is cooled and solidified to obtain a solidified product. At the pulverizing step, the solidified product is mechanically pulverized. At the classifying step, excessively pulverized toner particles and coarse toner particles are removed from the pulverized product obtained at the pulverizing step using a classifier. These steps make it possible to prepare the toner particles.

Examples of the mixer used for dry-mixing include Henschel type mixer such as HENSCHELMIXER (trade name, manufactured by Mitsui Mining Co., Ltd.), SUPERMIXER (trade name, manufactured by Kawata MEG Co., Ltd.) and MECHANOMIL (trade name, manufactured by Okada Seiko Co., Ltd.), ANGMIL (trade name, manufactured by Hosokawa Micron Corporation), HYBRIDIZATION SYSTEM (trade name, manufactured by Nara Machinery Co., Ltd.) and COSMOSYSTEM (trade name, manufactured by Kawasaki Heavy Industries, Ltd.).

The kneading is conducted with stirring while being heated at a temperature (usually, about 80 to about 200° C., preferably, about 100 to about 150° C.) higher than the melting temperature of the binder resin. As the kneader, a general kneader is usable, such as biaxial extruder, three-roll mill or a laboplast mill. Specific example thereof includes a monoaxial or biaxial extruder such as TEM-100B (trade name, manufactured by Toshiba Machine Co., Ltd.) or PCM-65/87 (trade name, manufactured by Ikegai, Ltd.), or the one of the open roll system such as KNEADEX (trade name, manufactured by Mitsui Mining Co., Ltd.). Among them, the one of the open roll system is preferred. The solidified product obtained by cooling the melt-kneaded product is pulverized by using a cutter mill, a Feather mill, a jet mill or the like. For example, the solidified product is coarsely pulverized by using the cutter mill and is then pulverized by the jet mill to obtain a toner having a desirable volume average particle size.

For the classification, a known classifier is usable that is capable of removing excessively pulverized toner particles and coarse toner particles through classification by a centrifugal force or wind force, and an example thereof includes a swivel pneumatic classifier (rotary pneumatic classifier).

Further, the toner particles can be manufactured by, for example, coarsely pulverizing the solidified product of the melt-kneaded product, forming an aqueous slurry of the obtained coarsely pulverized product, atomizing the obtained aqueous slurry by using a high-pressure homogenizer, and heating, aggregating and melting the obtained fine particles in an aqueous medium. The solidified product of the melt-kneaded product is coarsely pulverized by using, for example, the jet mill or the hand mill. Through the coarse pulverization, coarse particles having a particle size of about 100 μm to about 3 mm is obtained. The coarse particles are dispersed in water to prepare an aqueous slurry thereof. To disperse the coarse particles in water, for example, a dispersant such as sodium dodecylbenzenesulfonate is dissolved in a suitable amount in water to obtain an aqueous slurry in which the coarse particles are homogeneously dispersed. By treating the aqueous slurry using a high-pressure homogenizer, the coarse particles in the aqueous slurry are atomized so that an aqueous slurry including fine particles having a volume average particle size of about 0.4 to about 1.0 μm is obtained. The aqueous slurry is heated to aggregate fine particles which are then melt-bonded together to obtain a toner having a desirable volume average particle size and an average circularity degree. The volume average particle size and the average circularity degree can be set to desirable values by, for example, appropriately selecting the temperature for heating the aqueous slurry of fine particles and the time for heating. The heating temperature is appropriately selected from a temperature range which is not lower than the softening temperature of the binder resin and is lower than the thermal decomposition temperature of the binder resin. When the time for heating is the same, the volume average particle size of the toner increases as the heating temperature increases.

As the high-pressure homogenizer, one placed in the market has been known. Examples of the high-pressure homogenizer placed in the market include chamber-type high-pressure homogenizers such as MICROFLUIDIZER (trade name, manufactured by Microfluidics International Corporation), NANOMIZER (trade name, manufactured by Nanomizer Inc.) and ULTIMIZER (trade name, manufactured by Sugino Machine Limited), and HIGH-PRESSURE HOMOGENIZER (trade name, manufactured by Rannie Corporation), HIGH-PRESSURE HOMOGENIZER (trade name, manufactured by Sanmaru Machinery Co., Ltd.), HIGH-PRESSURE HOMOGENIZER (trade name, manufactured by Izumi Food Machinery Co., Ltd.) and NANO3000 (trade name, manufactured by Beryu Co., Ltd.).

The toner particles thus produced may be subjected to the spheroidizing treatment, and examples of a spheroidizing device include a shock type spheroidizing device and a hot air type spheroidizing device. As the shock type spheroidizing device, the one placed in the market is also usable, such as FACULTY (trade name, manufactured by Hosokawa Micron Corporation) and HYBRIDIZATION SYSTEM (trade name, manufactured by Nara Machinery Co., Ltd.). As the hot air type spheroidizing device, the one placed in the market is also usable, such as a surface modifying machine, METEORAINBOW (trade name, manufactured by Nippon Pneumatic Mfg. Co., Ltd.)

(External Additive)

To the toner particles thus obtained, an external additive having an average primary particle size of 50 nm or more, and preferably 0.1 μm or more, is externally added. This makes it possible to improve transfer property, particularly in a color toner. As the external additive, the one commonly used in the art is usable and examples thereof include a silicon oxide, a titanic oxide, a silicon carbide, an aluminum oxide and a barium titanate.

In addition to the examples above, at least one of external additives can be used in combination. The external additive usable in combination is not particularly limited and examples thereof include a silicon oxide, a titanic oxide, a silicon carbide, an aluminum oxide and a barium titanate. The average primary particle size of the external additives usable in combination is preferably 5 to 30 nm. By using the external additives having such a particle size in combination, toner fluidity can be improved. When the average primary particle size of the external additives usable in combination is less than 5 nm, uniform dispersion thereof is difficult. When the average primary particle size of the external additives usable in combination exceeds 30 nm, an effect of improving fluidity is insufficient.

It is possible to measure the average primary particle size of the external additive by using a particle size distribution-measuring device that utilizes dynamic scattering of light, such as DLS-800 (trade name, manufactured by Otsuka Electronics Co., Ltd.) and COULTER N4 (trade name, manufactured by Coulter Electronics Ltd.), however, since it is difficult to dissociate the secondary aggregation of particles subjected to the hydrophobic treatment, it is preferable to directly obtain the average primary particle size by analyzing the image photographed by using a scanning electron microscope (SEM) or a transmission electron microscope (TEM).

Further, the amount of addition of the external additive is not particularly limited, but it is preferably 0.1 to 3.0 parts by weight based on 100 parts by weight of the toner particles. When the amount of addition of the external additive is in such a range, it is possible to provide fluidity for the toner and to improve transfer efficiency. When the amount of addition of the external additive is less than 0.1 part by weight, it is impossible neither to provide sufficient fluidity for the toner nor to improve transfer efficiency. When the amount of addition of the external additive exceeds 3.0 parts by weight, the speed that the external additive is accumulated on the surface of the carrier gets fast and it becomes difficult to suppress reduction in the charge applying capability of the carrier against the toner even when the volume resistance values A and B of the carrier before and after the stirring test satisfy the above formula (2).

(2) Two-Component Developer

The two-component developer of the invention contains the resin coated carrier and the toner, and can stabilize the charging amount of the toner over a long period of time. Therefore, a high-quality image having small image defect such as fogging can stably be formed.

A mixing ratio of the toner and the resin coated carrier is not particularly limited, but in consideration of using for a high-speed image forming apparatus capable of printing A4-size images on 40 sheets or more per minute, it is preferable to use the one in which the ratio of the volume average particle size of the resin coated carrier to the volume average particle size of the toner is 5 or more and the coverage θ is about 50 to 75%. Thereby, charging property of the toner is stably maintained in a sufficiently excellent state, and it is possible to use as a suitable developer capable of stably forming a high-quality image over a long term even in a high-speed image forming apparatus.

It is possible to adjust a value of the coverage θ by a toner density in the developer. When the toner density in the developer is low (when the coverage θ is less than 50%), the charge amount of the toner is likely to increase, and when the toner density in the developer is high (when the coverage θ is greater than 75%), the charge amount of the toner is likely to decrease. It is therefore possible to adjust the charge amount to a certain level by using such phenomena. When the developer is provided in an actual apparatus to be used, however, as the toner density decreases, there occurs a problem of carrier attachment caused by an increase in a contact area of the carrier and a photoreceptor. Furthermore, as the toner density increases, toner scattering becomes serious with a decrease in the charge amount.

Specifically, a relationship between the coverage θ and the toner density is such that in a case where the volume average particle size of the toner is 6.5 μm and the volume average particle size of the resin coated carrier is 40 μm, when the coverage θ is 50 to 75%, about 6.9 to 10.4 parts by weight of the toner are included in the developer based on 100 parts by weight of the resin coated carrier. When performing high-speed development using such a developer, the amount of toner consumption and the amount of the supplied toner that is supplied in accordance with the toner consumption to a developing tank of a developing device become maximum, respectively, and a supply-demand balance is still never damaged. When the toner in the developer is more than about 6.9 to 10.4 parts by weight based on 100 parts by weight of the carrier, the charge amount is likely to further lowered so that a desirable developing property is not obtained and the amount of toner consumption becomes greater than the amount of the supplied toner so that application of sufficient charges to the toner is inhibited to cause deterioration of image quality. In contrast, when the amount of the carrier is small, the charge amount is likely to be high so that the toner is less likely to separate from the carrier by an electric field, resulting in deterioration of image quality.

The total projection area of the toner in the embodiment is calculated as follows. The calculation is performed based on the volume average particle size obtained by using a Coulter counter (trade name: COULTER COUNTER MULTISIZER II, manufactured by Beckmann Coulter, Inc.) with a specific gravity of the toner being 1.0. That is, the number of toner particles in the weight of the toner to be mixed is calculated, and a value obtained by multiplication of the number of toner particles by the toner area (calculated assuming as a circular)

is defined as the total projection area of the toner. In the same manner, the total surface area of the resin coated carrier is calculated from the weight of the carrier to be mixed based on the particle size obtained by using MICROTRAC (trade name: MICROTRAC MT3000, manufactured by NIKKISO CO., LTD.) with a specific gravity of the carrier being 4.7.

3. Developing Device

A developing device according to the embodiment of the invention develops an electrostatic latent image formed on an image bearing member to form a visible image by using the two-component developer of the invention. Since the two-component developer of the invention is capable of stabilizing the charge amount of the toner during long-term use, it is possible to realize a developing device capable of stably forming an excellent toner image without fogging over a long term by using the two-component developer of the invention.

Figure 3:
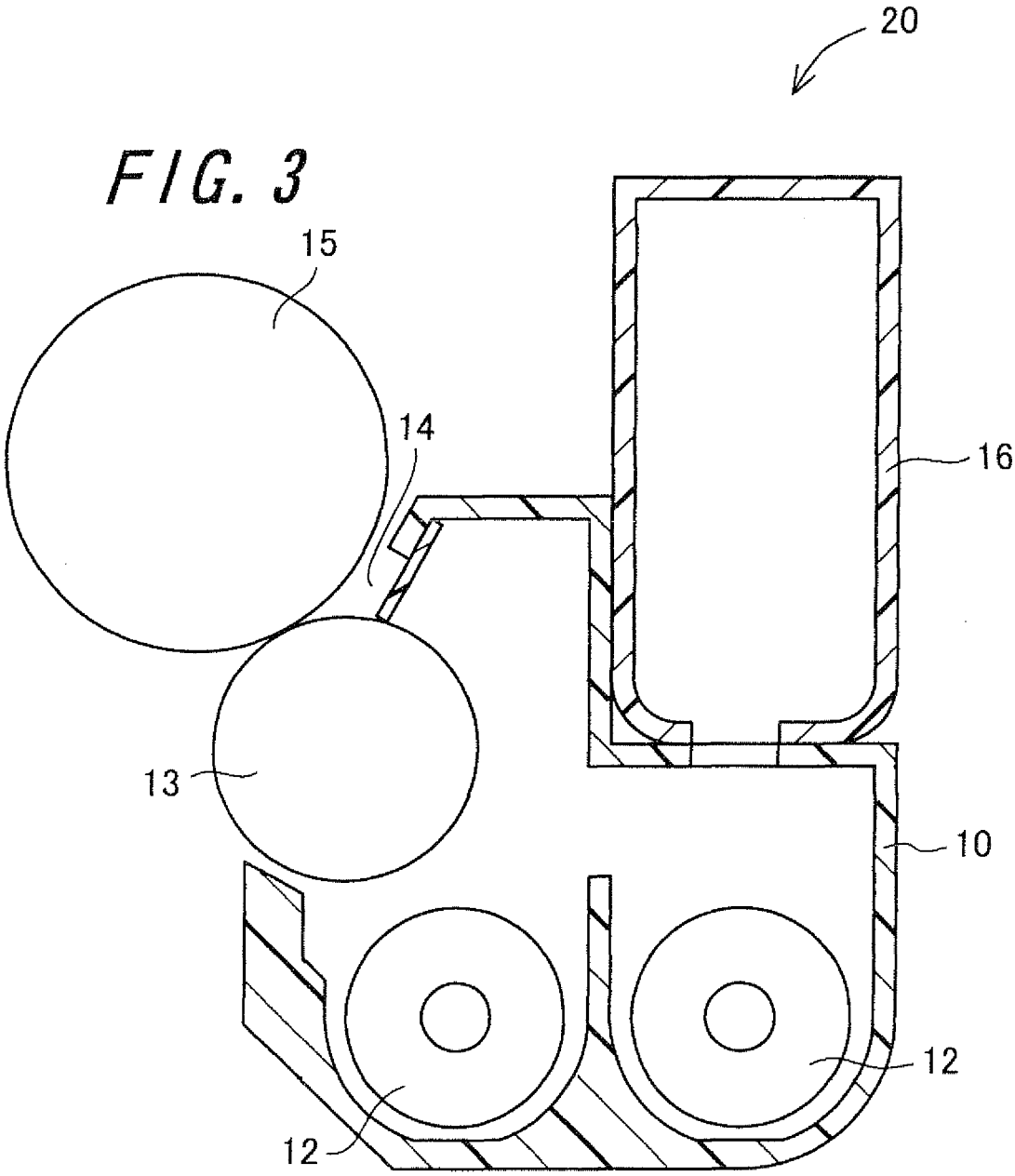
FIG. 3 is a schematic view showing a configuration of a developing device.

FIG. 3 is a schematic view showing a structure of the developing device 20 according to the embodiment. As shown in FIG. 3, the developing device 20 includes a developing unit 10 for storing the developer 1, and a developer bearing member (a developer-transporting bearing member) 13 for transporting the developer to a photoreceptor 15 serving as an image bearing member.

The developer, which is supplied in advance into the developing unit 10, is stirred to be charged by a stirring screw 12. The developer is transported to the developer bearing member 13, inside of which a magnet roller serving as a magnetic field generating section is provided, so as to be held on the surface of the developer bearing member 13. The developer held on the surface of the developer bearing member 13 is regulated to have a constant layer thickness by a developer regulating member 14 and transported to a development area formed in an area where the developer bearing member 13 and the photoreceptor 15 come close, and thereafter, an electrostatic charge image on the photoreceptor 15 is visualized through a reversal development method in an oscillating electric field formed by applying an AC bias voltage to the developer bearing member 13.

Further, the toner consumption resulting from formation of the visible image is detected by using a toner density sensor (not shown) as a variation of the toner density which is a ratio of the weight of the toner to the weight of the developer, and the consumed amount is replenished from a toner hopper 16 until the toner density sensor (not shown) detects that the toner density has reached a predetermined regulation level so that the toner density of the developer inside the developing unit 10 is maintained substantially at a constant level.

Furthermore, in the embodiment, a gap between the developer bearing member 13 and the developer regulating member 14, and a gap between the developer bearing member 13 and the photoreceptor 15 in the development area may be set to, for example, 0.4 mm. This is certainly only an example and not limited to the value.

4. Image Forming Apparatus

Figure 4:
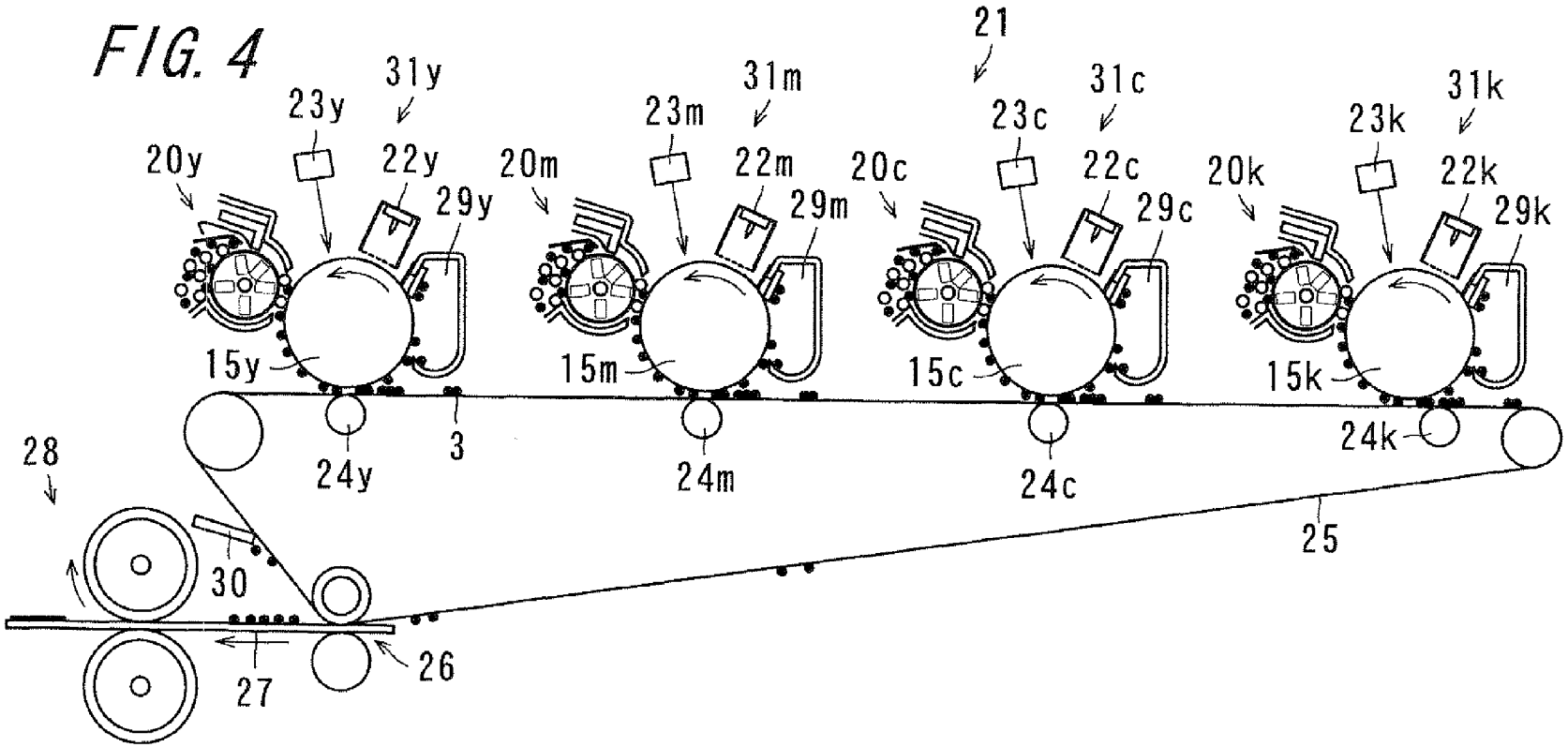
FIG. 4 is a schematic view showing a configuration of an image forming apparatus.

An image forming apparatus according to the embodiment of the invention includes the developing device 20. For the structure other than the developing device 20, a structure of a known electrophotographic image forming apparatus is applicable. FIG. 4 is a schematic view showing a structure of an image forming apparatus 21 according to the embodiment. The image forming apparatus 21 includes a visible image forming unit 31, a fixing section, and a cleaning section. In accordance with image information of respective colors of black (b), cyan (c) magenta (m), and yellow (y) which are contained in color image information, there are provided respectively four sets of members of the visible image forming unit 31. The four sets of respective members provided for the respective colors are distinguished herein by giving alphabets indicating the respective colors to the end of the reference numerals, and only the reference numerals are shown when the sets are collectively referred to. The visible image forming unit 31 includes an image bearing member, a charging section, an exposure section and a transfer section.

The photoreceptor 15 serving as the image bearing member is a roller-shaped member having a photosensitive layer capable of forming an electrostatic charge image on the surface thereof. A charging device 22 serving as the charging section charges the surface of the photoreceptor 15 to a predetermined potential. A laser light irradiating section 23 serving as the exposure section irradiates the surface of the photoreceptor 15 in a charged state with signal light corresponding to the image information to form an electrostatic charge image (electrostatic latent image) on the surface of the photoreceptor 15. The transfer section includes a primary transfer device 24 and a secondary transfer device 26, and the primary transfer device 24 transfers a toner image on the surface of the photoreceptor 15 that is developed by the toner 3 supplied from the developing device 20, to an intermediate transfer belt 25 serving as an intermediate transfer body. The secondary transfer device 26 transfers the toner image transferred to the intermediate transfer belt 25 to a recording medium 27. A fixing device 28 serving as the fixing section fixes the toner image on the surface of the recording medium 27 onto the recording medium 27. The cleaning section includes a cleaning device for photoreceptor 29 and a cleaning device for transfer 30, and the cleaning device for photoreceptor 29 removes the toner 3, paper dust and the like remaining on the surface of the photoreceptor 15 after the transfer of the toner image to the recording medium 27. The cleaning device for transfer 30 removes the redundant toner 3 and the like adhering to the intermediate transfer belt.

To develop an electrostatic charge image, a developing step for visualizing the electrostatic charge image on the surface of the photoreceptor 15 through a reversal development method is executed for each color of the toner and a plurality of toner images having different colors are overlaid on the intermediate transfer belt 25 to form a multi-color toner image. Although an intermediate transfer method using the intermediate transfer belt 25 is employed in the embodiment, a structure to transfer a toner image directly to a recording medium from the photoreceptor 15 may be employed.

According to the image forming apparatus 21 of the embodiment, the image forming apparatus 21 provided with the developing device 20 of the invention that is capable of forming a toner image without fogging on the photoreceptor 15 as described above is realized. By forming an image using such an image forming apparatus 21, it is possible to stably form a high-quality image without fogging over a long term.

EXAMPLES

Examples according to the invention and comparative examples will be described below. The invention is not limited to the examples, unless exceeding the scope thereof. Hereinafter, a "part" refers to a "part by weight". Further, unless otherwise mentioned, "%" refers to "% by weight".

<Toner>

The following describes the preparation of three kinds of toners (Toners 1 to 3).

(Toner 1)

Polyester (trade name: FC1494, manufactured by Mitsubishi Rayon Co., Ltd.) serving as a binder resin, a pigment (C.I. Pigment Red57:1), a release agent (trade name: HNP-11, manufactured by Nippon Seiro Co., Ltd.) and a charge control agent (trade name: LR-147, manufactured by Japan Carlit Co., Ltd) were dry-mixed and melt-kneaded, followed by a pulverizing step and a classifying step, to produce a toner particle. Two kinds of silica fine particles subjected to the hydrophobic treatment each of which has an average primary particle size of 0.1 μm and of 12 nm (hereinafter, referred to also as a "hydrophobized silica fine particle") were added to the toner particle to produce a negatively-charged magenta toner (non-magnetic magenta toner) having a volume average particle size of 6.5 μm. Hereinafter, this toner is referred to as Toner 1.

(Toner 2)

Toner 2 was produced in the same manner as Toner 1 except that a hydrophobized silica fine particle having an average primary particle size of 50 nm was used in place of the hydrophobized silica fine particle having an average primary particle size of 0.1 μm.

(Toner 3)

Toner 3 was produced in the same manner as Toner 1 except that only the hydrophobized silica having an average primary particle size of 12 nm was used as the external additive instead of using the hydrophobized silica fine particle having an average primary particle size of 0.1 μm.

<Resin Coated Carrier>

Fifteen resin coated carriers (Carriers 1 to 15) were produced as follows.

(Carrier 1)

In 12 parts of toluene, 0.375 part of a crosslinkable silicone resin A (trade name: KR240, manufactured by Shin-Etsu Chemical Co., Ltd. ($Mw=5.0\times10^2$)) and 0.375 part of a crosslinkable silicone resin A (trade name: KR251, manufactured by Shin-Etsu Chemical Co., Ltd. ($Mw=5.0\times10^5$)) were dissolved, and 0.0375 part of conductive particles (trade name: VULCAN XC-72, manufactured by Cabot Corporation) and 0.0225 part of a coupling agent (trade name: AY43-059, manufactured by Toray Dow Corning) were internally added to or dispersed in the resulting solution. Thus, a coating resin liquid was prepared. The surface of 100 parts of a carrier core (Mn—Mg ferrite) having a volume average particle size of 45 μm was coated with 12.8 parts of the coating resin liquid. The carrier core was passed through a curing step at a curing temperature of 200° C. for a curing time of 1 hour, and sieved with a sieve having an opening of 150 μm. Thus, Carrier 1 was produced. Herein, Mw represents a weight average molecular weight of each silicone resin. The weight average molecular weight Mw was obtained by preparing a mixed solution of only silicone resins and measuring a molecular weight distribution using toluene as a mobile phase with GPC (trade name: HLC-8320GPC, manufactured by Tosoh Corporation).

Carrier 1 has $Ma=5.0\times10^2$ and $Mb=5.0\times10^5$. Therefore, weight average molecular weight ratio X ($X=\log(Mb/Ma)$) described in the formula (1) is calculated to be X=3.0.

(Carriers 2 to 18)

Carriers 2 to 18 were produced in the same manner as Carrier 1 except that at least one of a kind of the silicone resin, the amount of addition of the silicone resin, the amount of addition of the conductive particle, the amount of addition of the coupling agent, and the volume average particle size of the carrier core was changed as shown in Table 1.

In the production of Carriers 2 to 18, the following silicone resins were used other than the crosslinkable silicone resins A and B.

Crosslinkable silicone resin C: trade name: KR350, manufactured by Shin-Etsu Chemical Co., Ltd. ($Mw=4.0\times10^3$)

Crosslinkable silicone resin D: trade name: TSR127B, manufactured by Momentive Performance Materials Japan LLC. ($Mw=4.0\times10^2$)

Further, volume average particle size of the carrier cores and the resin coated carriers was measured as follows.

(Measurement of Volume Average Particle Size)

The volume average particle size of the carrier cores and the resin coated carriers was measured by using MICROTRAC (trade name: MT-3000, NIKKISO CO., LTD.) Approximately 10 to 15 mg of a measurement sample was added to a 10 mL solution having 5% EMULGEN 109P (polyoxyethylene lauryl ether HLB 13.6, manufactured by Mao Corporation), the mixture was dispersed by an ultrasonic dispersing device for one minute, and approximately 1 mL of the mixture was added to a predetermined point of the MICROTRAC and then stirred for one minute, and thereafter, it was confirmed that the scattered light intensity was stable before making measurements.

Further, a rate of change in volume resistance Y was calculated as follows.

(Calculation of Rate of Change in Volume Resistance Y)

To calculate the rate of change in volume resistance Y, volume resistance B (Ω/cm) of a resin coated carrier under electric field of 1,000 V/cm before a stirring test was performed, volume resistance A (Ω/cm) of the resin coated carrier under electric field of 1,000 V/cm after the stirring test was performed, and then a value represented by the following equation was calculated.

$$Y=-\log(A/B)$$

Table 1 shows volume average particle size and amount used of a carrier core, kind and amount used (solid content) of a silicone resin, weight average molecular weight ratio X, amount used (solid content) of each additive, volume average particle size of a carrier, and ratio of change in volume resistance Y.

TABLE 1

| | Carrier core | | Coating resin solution | | | | | Resin coated carrier | |
|---|---|---|---|---|---|---|---|---|---|
| | Volume average | Amount | Silicone resin | | | Conductive agent | Coupling agent | Volume average | |
| Carrier | particle size (μm) | used (part) | Kind | Amount used (part) | X | Amount used (part) | Amount used (part) | particle size (μm) | Y |
| 1 | 45 | 100 | A | 0.375 | 3.0 | 0.0375 | 0.0225 | 45 | 1.6 |
| | | | B | 0.375 | | | | | |
| 2 | 45 | 100 | A | 0.75 | 3.0 | 0.075 | 0.045 | 45 | 0.55 |
| | | | B | 0.75 | | | | | |
| 3 | 45 | 100 | B | 0.6 | 2.1 | 0.06 | 0.04 | 45 | 0.6 |
| | | | C | 0.6 | | | | | |

TABLE 1-continued

| | Carrier core | | Coating resin solution | | | | | Resin coated carrier | |
|---|---|---|---|---|---|---|---|---|---|
| | Volume average | Amount | Silicone resin | | | Conductive agent | Coupling agent | Volume average | |
| Carrier | particle size (μm) | used (part) | Kind | Amount used (part) | X | Amount used (part) | Amount used (part) | particle size (μm) | Y |
| 4 | 45 | 100 | A | 0.15 | 3.0 | 0.015 | 0.009 | 45 | 2.4 |
| | | | B | 0.15 | | | | | |
| 5 | 45 | 100 | B | 0.2 | 2.1 | 0.02 | 0.012 | 45 | 1.4 |
| | | | C | 0.2 | | | | | |
| 6 | 45 | 100 | A | 0.6 | 3.0 | 0.09 | 0.054 | 45 | 0.35 |
| | | | B | 1.2 | | | | | |
| 7 | 45 | 100 | A | 0.1 | 3.0 | 0.01 | 0.006 | 45 | 2.6 |
| | | | B | 0.1 | | | | | |
| 8 | 45 | 100 | B | 0.75 | 2.1 | 0.075 | 0.045 | 45 | 0.4 |
| | | | C | 0.75 | | | | | |
| 9 | 45 | 100 | C | 0.3 | 1.0 | 0.03 | 0.018 | 45 | 0.1 |
| | | | D | 0.3 | | | | | |
| 10 | 45 | 100 | C | 0.75 | 1.0 | 0.075 | 0.045 | 45 | 0.0 |
| | | | D | 0.75 | | | | | |
| 11 | 45 | 100 | A | 0.375 | 3.0 | None | 0.0225 | 45 | 1.7 |
| | | | B | 0.375 | | | | | |
| 12 | 30 | 100 | A | 0.375 | 3.0 | 0.0375 | 0.0225 | 30 | 1.55 |
| | | | B | 0.375 | | | | | |
| 13 | 35 | 100 | A | 0.375 | 3.0 | 0.0375 | 0.0225 | 35 | 1.7 |
| | | | B | 0.375 | | | | | |
| 14 | 55 | 100 | A | 0.375 | 3.0 | 0.0375 | 0.0225 | 55 | 1.2 |
| | | | B | 0.375 | | | | | |
| 15 | 60 | 100 | A | 0.375 | 3.0 | 0.0375 | 0.0225 | 60 | 1.2 |
| | | | B | 0.375 | | | | | |
| 16 | 45 | 100 | A | 0.188 | 3.1 | 0.375 | 0.0225 | 45 | 1.4 |
| | | | B | 0.375 | | | | | |
| | | | D | 0.188 | | | | | |
| 17 | 45 | 100 | A | 0.15 | 3.0 | 0.0375 | 0.0225 | 45 | 1.3 |
| | | | B | 0.6 | | | | | |
| 18 | 45 | 100 | A | 0.6 | 3.0 | 0.0375 | 0.0225 | 45 | 1.8 |
| | | | B | 0.15 | | | | | |

From the weight average molecular weight ratio X and the change in volume resistance Y in Table 1, Carriers 1 to 5 and 11 to 18 are examples of the carriers of the invention, and Carriers 6 to 10 are comparative examples of the carriers.

<Two-Component Developer>

Example 1

Carrier 1 and Toner 1 were placed in a resin-made cylindrical vessel such that the coverage θ was 70%, and the resulting mixture was mixed and stirred on a double-driving plastic bottle rotating mount at 200 rpm for 1 hour. Thus, the two-component developer of Example 1 was produced.

Examples 2 to 14 and Comparative Examples 1 to 8

Two-component developers of Examples 2 to 14 and Comparative Examples 1 to 8 were produced in the same manner as in Example 1, except for changing at least one of the kind of a toner or the kind of a resin coated carrier as shown in Table 2.

TABLE 2

| Two-component developer | Toner | Resin coated carrier |
|---|---|---|
| Example 1 | Toner 1 | Carrier 1 |
| Example 2 | Toner 2 | Carrier 1 |
| Example 3 | Toner 1 | Carrier 2 |
| Example 4 | Toner 1 | Carrier 3 |
| Example 5 | Toner 1 | Carrier 4 |
| Example 6 | Toner 1 | Carrier 5 |
| Example 7 | Toner 1 | Carrier 11 |

TABLE 2-continued

| Two-component developer | Toner | Resin coated carrier |
|---|---|---|
| Example 8 | Toner 1 | Carrier 12 |
| Example 9 | Toner 1 | Carrier 13 |
| Example 10 | Toner 1 | Carrier 14 |
| Example 11 | Toner 1 | Carrier 15 |
| Example 12 | Toner 1 | Carrier 16 |
| Example 13 | Toner 1 | Carrier 17 |
| Example 14 | Toner 1 | Carrier 18 |
| Comparative Example 1 | Toner 3 | Carrier 1 |
| Comparative Example 2 | Toner 1 | Carrier 6 |
| Comparative Example 3 | Toner 2 | Carrier 6 |
| Comparative Example 4 | Toner 3 | Carrier 6 |
| Comparative Example 5 | Toner 1 | Carrier 7 |
| Comparative Example 6 | Toner 1 | Carrier 8 |
| Comparative Example 7 | Toner 1 | Carrier 9 |
| Comparative Example 8 | Toner 1 | Carrier 10 |

<Evaluation of Effects by Particle Size of External Additive>

Using the two-component developers of Examples 1 and 2 and Comparative Examples 1 to 4, effects by a particle size of an external additive externally added to a toner were evaluated in terms of life charge stability and transfer efficiency. The life charge stability and transfer efficiency were evaluated by the following evaluation method and evaluation standard. The measurement results in the evaluation are shown in Table 3.

(Life Charge Stability)

Two-component developers each including the carrier of Examples 1 and 2, and Comparative Examples 1 to 4 were set in a copier (printing speed of 50 ppm for color and 62 ppm for monochrome, trade name: MX-6201N manufactured by Sharp Corporation) which has a two-component developing device, and after 50,000 (hereinafter, referred to as "50 k") prints of an image with a coverage rate of 5% were produced at normal temperature and normal humidity, and the charge amounts of the two-component developers were measured. The charge amounts were measured by using a suction type charge amount measuring device. With respect to a difference from an initial charge amount in an absolute value, the case of being 3 μC/g or less was evaluated as "Good"; the case of exceeding 3 μC/g and being 5 μC/g or less was evaluated as "Not bad"; and the case of being greater than 5 μC/g was evaluated as "Poor".

(Transfer Efficiency)

Transfer efficiency of two-component developers each including the carrier of Example 1 and 2, and Comparative Examples 1 to 4 were calculated after 50 k prints of an image were produced in the same manner as the method for evaluating the life charge stability. The transfer efficiency T (%) was calculated by the following formula (4), and with respect to the transfer efficiency, the case of being 90% or more was evaluated as "Good", and the case of being less than 90% was evaluated as "Poor".

$$T(\%)=[Mp/(Md+Mp)]\times 100 \quad (4)$$

In the formula, Mp represents the weight of the toner on the surface of paper on which a predetermined chart has been copied. Md represents the weight of the toner remaining on the surface of the image bearing member (electrophotographic photoreceptor) when the predetermined chart is copied. The predetermined chart is the one in which patches of 4 cm by 4 cm are arranged at four corners of A4 paper (arranged 1.5 cm each inside from the edges of the paper) and a center part thereof. The weight of the toner remaining on the surface of the image bearing member was obtained by sucking the toner on the surface of the image bearing member using the suction type charge amount measuring device and measuring the amount of the toner thus sucked. Furthermore, the amount of the toner on the surface of the paper was also obtained in the same manner.

TABLE 3

| | Life charge stability (-μC/g) | | | Transfer efficiency |
|---|---|---|---|---|
| Two-component developer | Initial | 50k sheets | Evaluation | (Evaluation) |
| Example 1 | 35 | 33 | Good | 94 (Good) |
| Example 2 | 34 | 33 | Good | 92 (Good) |
| Comparative Example 1 | 35 | 35 | Good | 81 (Poor) |
| Comparative Example 2 | 29 | 15 | Poor | 91 (Good) |
| Comparative Example 3 | 30 | 20 | Poor | 90 (Good) |
| Comparative Example 4 | 31 | 29 | Good | 82 (Poor) |

As shown in Table 3, it was found from Comparative Examples 1 and 4 in which the external additive of 50 nm or more is not included in the toner that life charge stability was good but transfer efficiency was poor. Further, it was found from Examples 1 and 2 and Comparative Examples 2 and 3 in which the external additive of 50 nm or more is included in the toner that transfer efficiency was good, and life charge stability of Examples 2 and 3 was also good when the variation of a volume resistance value Y was within a range of 0.5 or more and 2.5 or less, whereas life charge stability of Comparative Examples 2 and 3 was poor when the variation of a volume resistance value Y before the stirring test was outside the range of 0.5 or more and 2.5 or less.

Thus, it is understood that when an external additive of 50 nm or more is added to a toner, transfer efficiency is good, but when a resin coated carrier other than the resin coated carrier of the invention is used together with such a toner, life charge stability is impaired.

<Evaluation of Two-Component Developer>

Life charge stability, transfer efficiency, image density, whiteness, developer feeding ratio, charge rising property, carrier adhesion and graininess of the two-component developers of Examples 1 and 3 to 14 and Comparative Examples 2 and 5 to 8 were evaluated. In the evaluation results of each item, the example that all evaluation results are "Good" was evaluated as "Excellent", the example that the evaluation result contains one "Not bad" and does not contain "Poor" was evaluated as "Good", the example that the evaluation result contains two or more "Not bad" and does not contain "Poor" was evaluated as "Not bad", and the example that the evaluation result contains "Poor" was evaluated as "Poor". The evaluation results are shown in Table 4. In the evaluation results of the two-component developer, when the evaluation result is "Excellent", "Good" or "Not bad", such a developer can be used as a developer.

Image density, whiteness, developer feeding ratio, charge rising property, carrier adhesion and graininess were evaluated by the following evaluation methods and evaluation standards. The evaluation method and the evaluation standard of the life charge stability and the transfer efficiency are the same as the above evaluation method and evaluation standard of the life charge stability and the transfer efficiency. The evaluation results in evaluation of each item are also shown in Table 4.

(Image Density)

Using each two-component developers of Examples 1 and 3 to 14 and Comparative Examples 2 and 5 to 8, 50 k prints of an image were produced in the same manner as the evaluation method for the life charge stability, and the image density of an image region was measured by an X-Rite 938 spectrodensitometer. With respect to the image density, the case of being 1.4 or more was evaluated as "Good", the case of being 1.3 or more and less than 1.4 was evaluated as "Not bad", and the case of being less than 1.3 was evaluated as "Poor".

(Whiteness)

Using each two-component developers of Examples 1 and 3 to 14 and Comparative Examples 2 and 5 to 8, 50 k prints of an image were produced in the same manner as the evaluation method for life charge stability, and whiteness of a non-image region was measured. With respect to the whiteness, tristimulus values X, Y, and Z were obtained by an SZ90 spectral color difference meter manufactured by Nippon Denshoku Industries Co., Ltd., and with respect to the value of Z; the case of being 0.5 or less was evaluated as "Good", the case of being greater than 0.5 and 0.7 or less was evaluated as "Not bad", and the case of being greater than 0.7 was evaluated as "Poor".

(Developer Feeding Ratio)

A developing unit 10 was removed from a developing device 20 shown in FIG. 3, and a developer feeding ratio of a two-component development in the developing unit 10 was measured. A developing unit removed from a copier (trade name: MX-4500N, manufactured by Sharp Corporation) was used as the developing unit 10.

The two-component developers of Examples 1 and 3 to 14 and Comparative Examples 2 and 5 to 8 were set in the developing units 10, respectively, and developing units 10 were placed in a thermostat bath maintained at a temperature of 52.5° C. A developer bearing member 13 was rotated at 430 rpm for 1.5 hours, and simultaneously, the two-component developer was stirred by a stirring screw 12. Thereafter, the amount of the two-component developer fed to the developer bearing member 13 by the stirring screw 12 was measured.

Specifically, to obtain a drop amount A of the two-component developer in the developing unit 10 before introducing the developing unit in the thermostat bath, the developer bearing member 13 is driven at 50 rpm, and the two-component developer is dropped from a hole for dropping a developer while rotating the stirring screw 12 driven through a gear. The amount of a developer dropped is measured. After the measurement, the developing unit 10 is placed in a thermostat bath set to a temperature environment of 52.5° C., and the developer bearing member 13 is driven at a rotation speed of 430 rpm for 90 minutes, thereby applying mechanical stress to the two-component developer in the developing unit 10. Thereafter, a drop amount B of the two-component developer is obtained in the same manner as in the case before introducing the developing unit in the thermostat bath.

Ratio between the drop amount A before introducing the developing unit in the thermostat bath and the drop amount B after introducing the unit in the thermostat bath was used as a developer feeding ratio. The developer feeding ratio is an index showing fluidity of a two-component developer deteriorated at an accelerated rate. When the developer feeding ratio is 50% or more, it was evaluated as "Good", when the developer feeding ratio is from 30% to less than 50%, it was evaluated as "Not bad", and when the developer feeding ratio is less than 30%, it was evaluated as "Poor".

(Charge Rising Property)

Two-component developers of Examples 1 and 3 to 14 and Comparative Examples 2 and 5 to 8 were contained in a 5 ml glass bottle, which were stirred in a 32 rpm rotary cultivator for 1 minute, and then the two-component developers were gathered and the charge amounts thereof were measured with a suction type charge amount measuring device (210H-2A Q/M Meter, manufactured by TREK). The charge amounts thereof were measured in the same manner after stirring for 3 minutes. With respect to the difference between absolute values of the charge amounts after 1 minute and after 3 minutes, the case of being less than 5 μC/g was evaluated as "Good", the case of being 5 μC/g or more and 7 μC/g or less was evaluated as "Not bad", and the case of being greater than 7 μC/g was evaluated as "Poor".

(Carrier Adhesion)

After 50 k prints of an image were produced in the same manner as the evaluation method for life charge stability of two-component developers of Examples 1 and 3 to 14 and Comparative Examples 2 and 5 to 8, the number of carriers adhered in a constant area (297 mm×24 mm) of a non-image region on the image bearing member was obtained. When obtaining the number of carriers adhered, a DC bias voltage applied to the developer bearing member was 200 V, an AC bias voltage was 400 V, a frequency was 9 kHz and the surface of the image bearing member was not charged. With respect to the number of carriers adhered, the case of being less than 15 was evaluated as "Good", the case of being 15 or more and 20 or less was evaluated as "Not bad", and the case of being greater than 20 was evaluated as "Poor".

(Graininess)

Two-component developers of Examples 1 and 3 to 14 and Comparative Examples 2 and 5 to 8 were set in a copier (trade name: MX-6201N manufactured by Sharp Corporation) which has a two-component developing device, and after 50 k prints of an image were produced in the same manner as the evaluation method for life charge stability, a test chart of the image was printed to measure score values of graininess with color differences from white color of 30, 50, and 70 by using an automatic printer image quality evaluation system (trade name: APQS, manufactured by Oji Scientific Instruments). The lower score value of the graininess shows that the image has little roughness and is of high quality. Here, with respect to the maximum value of the respective score values of color difference, the case of being less than 11500 was evaluated as "Good", the case of being 11500 or more and 12000 or less was evaluated as "Not bad", and the case of being greater than 12000 was evaluated as "Poor".

TABLE 4

| Two-component developer | Life charge stability (-μC/g) Initial | 50k sheets | Evaluation | Image density (Evaluation) | Whiteness (Evaluation) | Developer feeding ratio (Evaluation) |
|---|---|---|---|---|---|---|
| Example 1 | 35 | 33 | Good | 1.4 (Good) | 0.3 (Good) | 53 (Good) |
| Example 3 | 31 | 26 | Not bad | 1.5 (Good) | 0.4 (Good) | 68 (Good) |
| Example 4 | 30 | 25 | Not bad | 1.5 (Good) | 0.4 (Good) | 50 (Good) |
| Example 5 | 34 | 32 | Good | 1.4 (Good) | 0.3 (Good) | 38 (Not bad) |
| Example 6 | 33 | 30 | Good | 1.5 (Good) | 0.3 (Good) | 32 (Not bad) |
| Example 7 | 32 | 30 | Good | 1.5 (Good) | 0.3 (Good) | 55 (Good) |
| Example 8 | 36 | 33 | Good | 1.4 (Good) | 0.3 (Good) | 36 (Not bad) |
| Example 9 | 35 | 33 | Good | 1.4 (Good) | 0.3 (Good) | 45 (Not bad) |
| Example 10 | 34 | 32 | Good | 1.4 (Good) | 0.3 (Good) | 63 (Good) |
| Example 11 | 34 | 32 | Good | 1.4 (Good) | 0.3 (Good) | 65 (Good) |
| Example 12 | 37 | 32 | Not bad | 1.4 (Good) | 0.3 (Good) | 60 (Good) |
| Example 13 | 37 | 33 | Not bad | 1.4 (Good) | 0.3 (Good) | 58 (Good) |
| Example 14 | 33 | 30 | Good | 1.4 (Good) | 0.3 (Good) | 48 (Not bad) |

TABLE 4-continued

| | | | | | | |
|---|---|---|---|---|---|---|
| Comparative Example 2 | 25 | 18 | Poor | 1.6 (Good) | 0.7 (Not bad) | 70 (Good) |
| Comparative Example 5 | 34 | 32 | Good | 1.4 (Good) | 0.3 (Good) | 27 (Poor) |
| Comparative Example 6 | 28 | 20 | Poor | 1.6 (Good) | 0.6 (Not bad) | 59 (Good) |
| Comparative Example 7 | 32 | 15 | Poor | 1.6 (Good) | 0.8 (Poor) | 23 (Poor) |
| Comparative Example 8 | 34 | 15 | Poor | 1.6 (Good) | 0.8 (Poor) | 35 (Not bad) |

| Two-component developer | Charge rising property (-μC/g) After 1 min | After 3 min | Evaluation | Transfer efficiency (Evaluation) | Carrier adhesion (Evaluation) | Graininess (Evaluation) | Evaluation result |
|---|---|---|---|---|---|---|---|
| Example 1 | 25 | 29 | Good | 94 (Good) | 9 (Good) | 11300 (Good) | Excellent |
| Example 3 | 26 | 29 | Good | 92 (Good) | 5 (Good) | 11450 (Good) | Good |
| Example 4 | 25 | 27 | Good | 92 (Good) | 7 (Good) | 11500 (Not bad) | Not bad |
| Example 5 | 25 | 28 | Good | 93 (Good) | 18 (Not bad) | 11350 (Good) | Not bad |
| Example 6 | 27 | 29 | Good | 93 (Good) | 18 (Not bad) | 11400 (Good) | Not bad |
| Example 7 | 23 | 30 | Not bad | 91 (Good) | 8 (Good) | 11500 (Not bad) | Not bad |
| Example 8 | 25 | 29 | Good | 93 (Good) | 19 (Not bad) | 11250 (Good) | Not bad |
| Example 9 | 25 | 29 | Good | 93 (Good) | 14 (Good) | 11250 (Good) | Good |
| Example 10 | 24 | 27 | Good | 92 (Good) | 8 (Good) | 11800 (Not bad) | Good |
| Example 11 | 24 | 27 | Good | 92 (Good) | 7 (Good) | 11950 (Not bad) | Good |
| Example 12 | 26 | 30 | Good | 92 (Good) | 7 (Good) | 11450 (Good) | Good |
| Example 13 | 26 | 29 | Good | 92 (Good) | 8 (Good) | 11450 (Good) | Good |
| Example 14 | 24 | 27 | Good | 92 (Good) | 10 (Good) | 11450 (Good) | Good |
| Comparative Example 2 | 15 | 21 | Not bad | 91 (Good) | 5 (Good) | 12200 (Poor) | Poor |
| Comparative Example 5 | 26 | 28 | Good | 93 (Good) | 23 (Poor) | 11450 (Good) | Poor |
| Comparative Example 6 | 25 | 29 | Good | 90 (Good) | 10 (Good) | 11600 (Not bad) | Poor |
| Comparative Example 7 | 27 | 30 | Good | 92 (Good) | 10 (Good) | 11700 (Not bad) | Poor |
| Comparative Example 8 | 28 | 31 | Good | 92 (Good) | 8 (Good) | 11750 (Not bad) | Poor |

As shown in Table 4, the life charge stability is not poor (Poor) in the two-component developers of Examples 1 and 3 to 14, whereas the life charge stability is poor (Poor) in the two-component developers of Comparative Examples 2 and 6 to 8. The reason why the life charge stability is poor (Poor) in the two-component developers of Comparative Examples 2 and 6 to 8 is as follows. Carriers 6 and 8 to 10 in the two-component developers of Comparative Examples 2 and 6 to 8 are that the change in volume resistance Y is not 0.5 to 2.5, that is, are not carriers having appropriate hardness. As a result, decrease in charging amount generated by adhesion of an external additive due to long-term use is not suppressed. In particular, the two-component developers of Comparative Examples 7 and 8 containing Carriers 9 and 10 having the weight average molecular weight ratio X smaller than 2 increase adhesion amount of an external additive, and as a result, charging amount is greatly decreased.

Further, as shown in Table 4, the developer feeding ratio is not poor (Poor) in the two-component developers of Examples 1 and 3 to 14, whereas the developer feeding ratio is poor (Poor) in the two-component developers of Comparative Examples 5 and 7. The reason why the developer feeding ratio is poor (Poor) in the two-component developers of Comparative Example 7 is as follows. Carrier 9 in the two-component developer of Comparative Example 7 has the weight average molecular weight ratio X smaller than 2. As a result, blocking of a developer is easy to be generated. Furthermore, Carrier 7 in the two-component developer of Comparative Example 5 has the weight average molecular weight ratio X of a large value of 2.6, unlike Comparative Example 7, but the developer feeding ratio is poor (Poor). This is because Carrier 7 has too small resin amount, and exposed area of a carrier core is large, and as a result, toner spent is easy to be caused, and the developer feeding properties are deteriorated. Carrier 10 in the two-component developer of Comparative Example 8 is that the weight average molecular weight ratio X is a small value of 1.0, like Comparative Example 7, but the developer feeding ratio is not poor (Poor). This is because Carrier 10 has a large resin amount as compared with Carrier 7, and as a result, exposed area of a carrier core is small, and toner spent is difficult to be generated.

Therefore, it is understood that Examples 1 and 3 to 14 in which the weight average molecular weight ratio X of a silicone resin used in a resin coating layer of a resin coated carrier in a developer is larger than 2 and the change in volume resistance Y is 0.5 to 2.5 are that the charging amount is stabilized over a long period of time, and additionally, decrease in feeding amount is suppressed. Furthermore, it is understood that when the weight average molecular weight ratio X of a silicone resin is smaller than 2 as in Carriers 9 and 10 contained in Comparative Examples 7 and 8, a resin coated carrier having the change in volume resistance Y of 0.5 to 2.5 is not obtained even though the introduction amount of a resin in the formation of a resin coating layer is changed.

Further, all of the two-component developers of Examples 1 and 3 to 14 are that whiteness is good (Good). It is understood from this fact that when the two-component developers of Examples 1 and 3 to 14 are used, a toner is stably charged and fogging is difficult to be generated.

Furthermore, as shown in Table 4, it is understood from the result on the two-component developer of Comparative Example 5 that when the value of the change in volume resistance Y of a resin coated carrier is more than 2.5, the charging amount is stabilized, but carrier adhesion after printing 50 k sheets is increased by the decrease in volume resistance of the resin coated carrier.

Moreover, as shown in Table 4, it is understood from the comparison between the result with the two-component developer of Example 1 and the result with the two-component developer of Example 7 that when the resin coating layer contains conductive particles, charge rising property is improved. Therefore, it is understood that a carrier containing conductive particles in a resin coating layer is preferred.

Further, as shown in Table 4, it is understood from the comparison between the result with the two-component developer of Example 1 and the results with the two-component developers of Examples 8 and 9 that when the volume average particle size of the resin coated carrier is larger than 35 μm, the developer feeding ratio is improved. Carrier 4 in the two-component developer of Example 5 and Carrier 5 in the two-component developer of Example 6 have the volume average particle size of 45 μm, but the developer feeding ratio is not bad (Not bad). Carrier 4 and Carrier 5 have small amount of resin. As a result, a carrier core was exposed on the surface by stirring in evaluating the developer feeding ratio, fluidity of a developer was deteriorated, and the developer feeding ratio was slightly deteriorated.

Furthermore, as shown in Table 4, it is understood from the comparison between the result with the two-component developer of Example 1 and the result with the two-component developer of Example 8 that when the volume average particle size of the resin coated carrier is larger than 35 μm, carrier adhesion is suppressed. Carrier 4 in the two-component developer of Example 5 and Carrier 5 in the two-component developer of Example 6 have the volume average particle size of 45 μm, but the carrier adhesion is not bad (Not bad). Carrier 4 and Carrier 5 have small resin amount. As a result, a carrier core was exposed on the surface by printing of 50 k sheets in evaluating the carrier adhesion, resistance of a carrier was decreased, and carrier adhesion was slightly increased.

Moreover, as shown in Table 4, it is understood from the comparison between the result with the two-component developer of Example 1 and the result with the two-component developers of Examples 10 and 11 that when the volume average particle size of the resin coated carrier is smaller than 55 μm, deterioration of graininess is suppressed. Further, Carrier 4 in the two-component developer of Example 5 and Carrier 11 in the two-component developer of Example 7 have the volume average particle size of 45 μm, but the graininess is not bad (Not bad). Carrier 4 has small amount of resin. As a result, a carrier core was exposed on the surface by printing of 50 k sheets in evaluating the graininess, the charging amount of a toner was decreased, and graininess was slightly deteriorated. Carrier 11 does not contain a conductive agent. Therefore, carrier resistance was slightly high, and graininess was slightly deteriorated.

Therefore, it is understood that the volume average particle size of the resin coated carrier is preferably 35 to 55 μm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A resin coated carrier which is used together with a toner comprising toner particles and an external additive having an average primary particle size of 50 nm or more externally added thereto, comprising:

a carrier core; and a resin coating layer comprising a resin comprising at least two of silicone resins having different weight average molecular weight, formed on a surface of the carrier core, the resin coating layer satisfying the following formula (1):

$$\log(Mb/Ma)>2 \quad (1)$$

in which Ma is a weight average molecular weight of a silicone resin having the minimum weight average molecular weight out of the at least two of silicone resins, and Mb is a weight average molecular weight of a silicone resin having the maximum weight average molecular weight out of the at least two of silicone resins contained in the resin coating layer, and the following formula (2) being satisfied:

$$0.5 \leqq -\log(A/B) \leqq 2.5 \quad (2)$$

in which A is a volume resistance (Ω/cm) under electric field of 1,000 V/cm obtained by conducting a stirring test, and B is a volume resistance (Ω/cm) under electric field of 1,000 V/cm before the stirring test.

2. The resin coated carrier of claim 1, wherein conductive particles are contained in the resin coating layer.

3. The resin coated carrier of claim 1, wherein the volume average particle size of the resin coated carrier is 35 to 55 μm.

4. A two-component developer comprising the resin coated carrier of claim 1 and a toner to which an external additive having an average primary particle size of 50 nm or more is externally added.

5. A developing device which carries out development using the two-component developer of claim 4.

6. An image forming apparatus comprising the developing device of claim 5.

* * * * *